US009643333B2

(12) United States Patent
Paden

(10) Patent No.: US 9,643,333 B2
(45) Date of Patent: May 9, 2017

(54) MANUAL WOOD SPLITTING ASSISTANCE APPARATUS

(71) Applicant: Jack R. Paden, Arlington, WA (US)

(72) Inventor: Jack R. Paden, Arlington, WA (US)

( * ) Notice: Subject to any disclaimer, the term of this patent is extended or adjusted under 35 U.S.C. 154(b) by 1003 days.

(21) Appl. No.: 13/915,473

(22) Filed: Jun. 11, 2013

(65) Prior Publication Data

US 2013/0327443 A1 Dec. 12, 2013

Related U.S. Application Data

(60) Provisional application No. 61/689,639, filed on Jun. 11, 2012.

(51) Int. Cl.
*B27L 7/00* (2006.01)

(52) U.S. Cl.
CPC ..... *B27L 7/00* (2013.01)

(58) Field of Classification Search
CPC ..... B25B 5/064; B27L 7/00
USPC ..... 269/105, 107, 109, 153, 155, 156, 166, 269/167, 218, 287; 29/281.1
See application file for complete search history.

(56) References Cited

U.S. PATENT DOCUMENTS 328,007 A * 10/1885 Coffin ..... A47G 33/1213 248/524
4,199,015 A 4/1980 Doering
4,239,198 A 12/1980 Trupp
4,326,703 A 4/1982 Marley
4,515,195 A 5/1985 Gladstein
5,114,113 A * 5/1992 Krinner ..... A47G 33/1213 248/525
5,673,893 A * 10/1997 Klein ..... A47G 33/1206 248/525
6,094,859 A * 8/2000 Kalman ..... A47G 33/1213 248/416

FOREIGN PATENT DOCUMENTS

EP 0519150 5/1995
WO 98-48988 11/1998

* cited by examiner

*Primary Examiner* — Larry E Waggle, Jr.
*Assistant Examiner* — Henry Hong

(57) ABSTRACT

A log section splitting assistance apparatus comprises a base with radially arranged fingers, each of which is joined to the base at an axle, each axle having an axis of rotation which is horizontally oriented and tangential to the base. The fingers extend and retract through use of a lever arm. A user places a log section on the base, between the fingers. The user engages the lever arm to hold the log section on the base with the fingers. The user splits the log section. The fingers retain the split pieces on the base in a cluster until the pieces can be removed. The base and fingers may be rotated by foot, allowing the log section to be conveniently rotated as it is split. The user avoids bending; the splitting process proceeds quickly. The apparatus is robust and easy to use.

17 Claims, 28 Drawing Sheets

MANUAL WOOD SPLITTING ASSISTANCE APPARATUS

CROSS-REFERENCE TO RELATED APPLICATIONS

This application claims priority to U.S. provisional patent application No. 61/689,639, filed on Jun. 11, 2012, which application is incorporated herein in its entirety for all purposes.

BACKGROUND

Preparation of firewood for burning often involves splitting log sections into smaller pieces. The traditional manual method involves a person placing a log section onto a stump and splitting the log section with an axe, a splitting maul, and/or wedge (hereinafter, an "axe"). As the person splits the log section, the pieces (or even the entire log section) fall to the ground, typically after each blow. The split pieces must be picked up and repositioned on the stump for further splitting or must be picked up to be stacked or piled. Bending to pick up the split pieces may result in back strain and slows down the process of manually splitting firewood. In addition, the pieces may no longer be stable when placed on the stump, notwithstanding that they may require additional splitting. The person may attempt to split a piece, notwithstanding that it is not stable on the stump, resulting in risk of injury.

People have developed a technique of wrapping a rope or elastic cord around a log section, splitting the wrapped log section, and walking radially around the wrapped log section to continue splitting the log section into multiple, smaller, pieces. While this reduces the amount of bending and lifting, wrapping the log section and unwrapping the pieces takes time, the unwrapped pieces are apt to fall to the ground (requiring bending and lifting), and the axe or wood pieces may become entangled with and/or cut the rope or elastic cord during the splitting process, resulting in unpredictable and potentially hazardous circumstances.

Power splitting machines are available, but they cost a significant amount relative to an individual's need to split a quantity of wood for one season, they operate slowly, often with inconvenient safety checks and features, they require fuel or electricity, lubricants, maintenance, they take up space and are difficult to store, and the initial log section and then split pieces must be arranged on the splitter and picked up, which involves bending, back strain, and human interaction with relatively high-power and potentially dangerous mechanical equipment.

DETAILED DESCRIPTION

Figure 1:
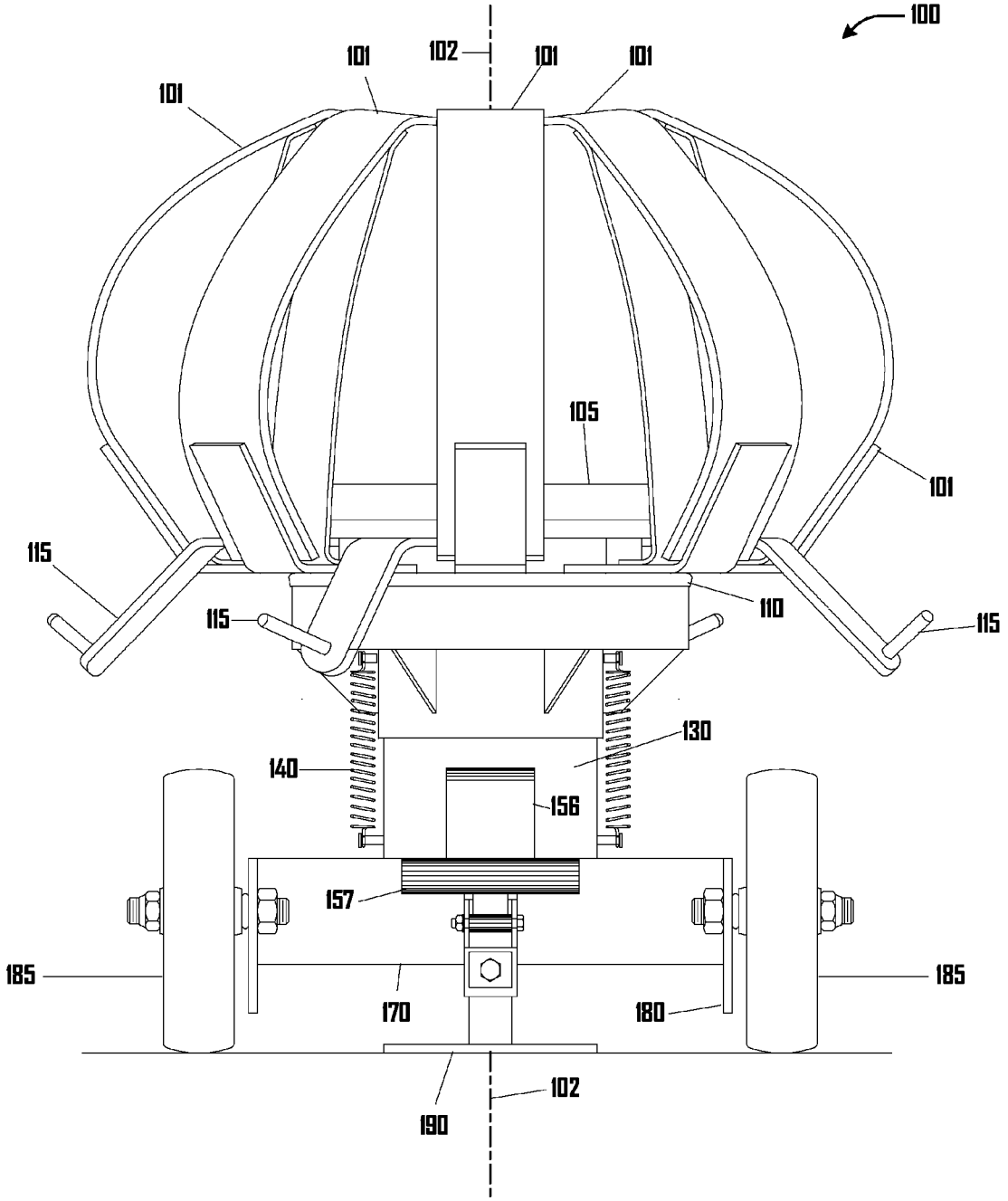
FIG. 1 illustrates an elevation view of an embodiment, looking at the front end, at which a user would typically stand.

The following description provides specific details for an understanding of various examples of the technology. One skilled in the art will understand that the technology may be practiced without many of these details. In some instances, structures and functions have not been shown or described in detail or at all to avoid unnecessarily obscuring the description of the examples of the technology. It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

As used herein, "releasable," "connect," "connected," "connectable," "disconnect," "disconnected," and "disconnectable" refers to two or more structures which may be repeatedly connected or disconnected, without the use of tools (examples of tools including screwdrivers, pliers, hammers, drills, saws, welding machines, torches, irons, and other heat sources) or solvents. As used herein, "attach," "attached," "attachable," "unattach," or "unattached" refers to two or more structures which may be attached or unattached, but generally requiring the use of tools or chemical or physical bonding. As used herein, "joined" components refers to two or more structures which may be attached or connected. Joined components may move in relation to one another, though generally with one or more degrees of freedom being limited. As used herein, "axle" refers to joined components, which joined components intersect at an axis and may move with at least one degree of freedom about the axis; the range of motion about the axis may be less than a complete circle.

Generally, the element numbers in the drawings begin with a number which identifies which figure the particular element is first numbered in. Elements in certain of the Figures may not be shown or are hidden to avoid obscuring other elements; hidden or not shown elements may or may not be called out. Elements in certain of the Figures may illustrate an incorrect transparency relationship relative to other components (for example, in FIG. 4, one of the Outriggers is illustrated as being in front of a neighboring Finger, when, according to the plane view in FIG. 2, the Outrigger should be behind the neighboring Finger).

In general terms (described further herein), a log section Splitting Assistance Apparatus comprises a Base with radially arranged Fingers, each of which is joined to the Base at an axle, each axle having an axis of rotation which is horizontally oriented and tangential to the Base. In an example of use, the Fingers are retracted and a Lever Arm which controls the Fingers is rotated up. A user places a log section, vertically oriented, on the Base, between the Fingers. The user taps a Foot Switch on the Lever Arm to release a Latch Mechanism and applies pressure to and depresses the Lever Arm, causing the Fingers to extend toward the center of the Base, which Fingers contact and connect the log section to the Base. The log section is split. The Fingers retain the pieces on the Base in a cluster until the pieces are removed. The Base may be rotated by foot, allowing the log section to be conveniently rotated as it is split. The Fingers are adjustable to accommodate log sections of different sizes. The Apparatus reduces bending and lifting and speeds up the manual splitting process. The Apparatus is robust, able to withstand axe blows, easy to use, and relatively straight-forward to manufacture and service.

FIG. 1 illustrates an elevation view of an embodiment, looking at the front end, at which a user would typically stand. This embodiment of a Splitting Assistance Apparatus 100 comprises Fingers 101 which may connect a log section to the Apparatus 100, a Chopping Surface 105 on which the base of the connected log section may rest, a Finger Control Ring 110 which controls the extent to which the tips of the Fingers 101 are extended (toward the Central Vertical Axis 102 of the Chopping Surface 105) or retracted (away from the Central Vertical Axis 102), Outriggers 115 which allow the top of the Splitting Assistance Apparatus 100 and a connected log section to be rotated with, for example, a foot as the log section is split (the Outriggers 115 may also be referred to herein as a "projection"), a Column 130 on or with respect to which the Finger Control Ring 110 may slide up or down upon Bushings 733 (illustrated in FIG. 7), a Latch Cover 156, which covers a Latch Mechanism 768 (illustrated in FIG. 7), a Foot Actuator 157 which the user places downward pressure on (generally with a foot) to extend or retract the Fingers 101 (extending and retracting the Fingers is discussed further herein), a Main Frame 170 to which the other components are joined, two Wheels 185, a Third Contact Leg 190 which provides a third point of contact with the ground in addition to the Wheels 185, and a Wheel Mounting Plate 180. The Third Contact Leg 190 and the Wheels 185 may have an adjustable connection or attachment to the Main Frame 170, allowing the height of the apparatus to be adjusted.

The Fingers 101 illustrated in FIG. 1 are provided as an example; additional examples of Finger embodiments are discussed in relation to FIGS. 16 through 28 and are illustrated in other Figures.

Figure 2:
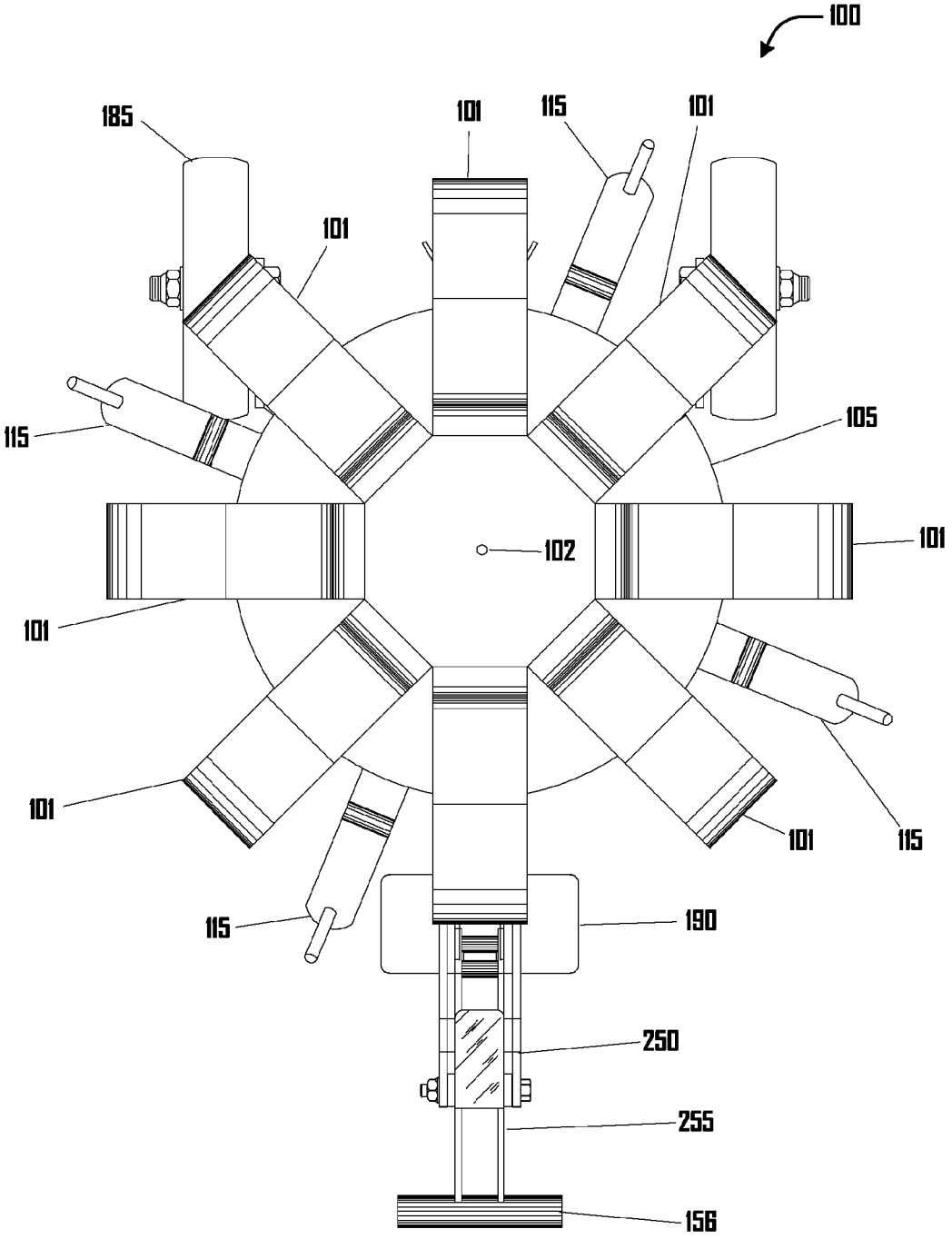
FIG. 2 illustrates a top plan view of the embodiment illustrated in FIG. 1.

FIG. 2 illustrates a top plan view of the embodiment illustrated in FIG. 1. This view illustrates that this embodiment of the Splitting Assistance Apparatus 100 comprises eight Fingers 101 and four Outriggers 115. Other embodiments with a different number of Fingers and/or Outriggers 115 are discussed in relation to FIGS. 16 through 28; fewer and/or an odd number of Fingers (such as three, five, seven, and similar) and/or Outriggers may be utilized (such as three, five, seven, and similar; the number of Outriggers may be but does not need to be equal to or a fraction of the number of Fingers). Arrows in FIG. 2 also illustrate that the Fingers 101 and the Chopping Surface 105 may rotate about the Central Vertical Axis 102 of the Chopping Surface 105 as the user, for example, rotates the Outriggers 115 about the Central Vertical Axis 102 by foot. FIG. 2 also illustrates a Primary Lever Arm 250 and a Secondary Lever Arm 255, to which the Foot Actuator 157 is attached. The Primary Lever Arm 250 and the Secondary Lever Arm 255 may be referred to herein together as a "Lever Arm."

Figure 3:
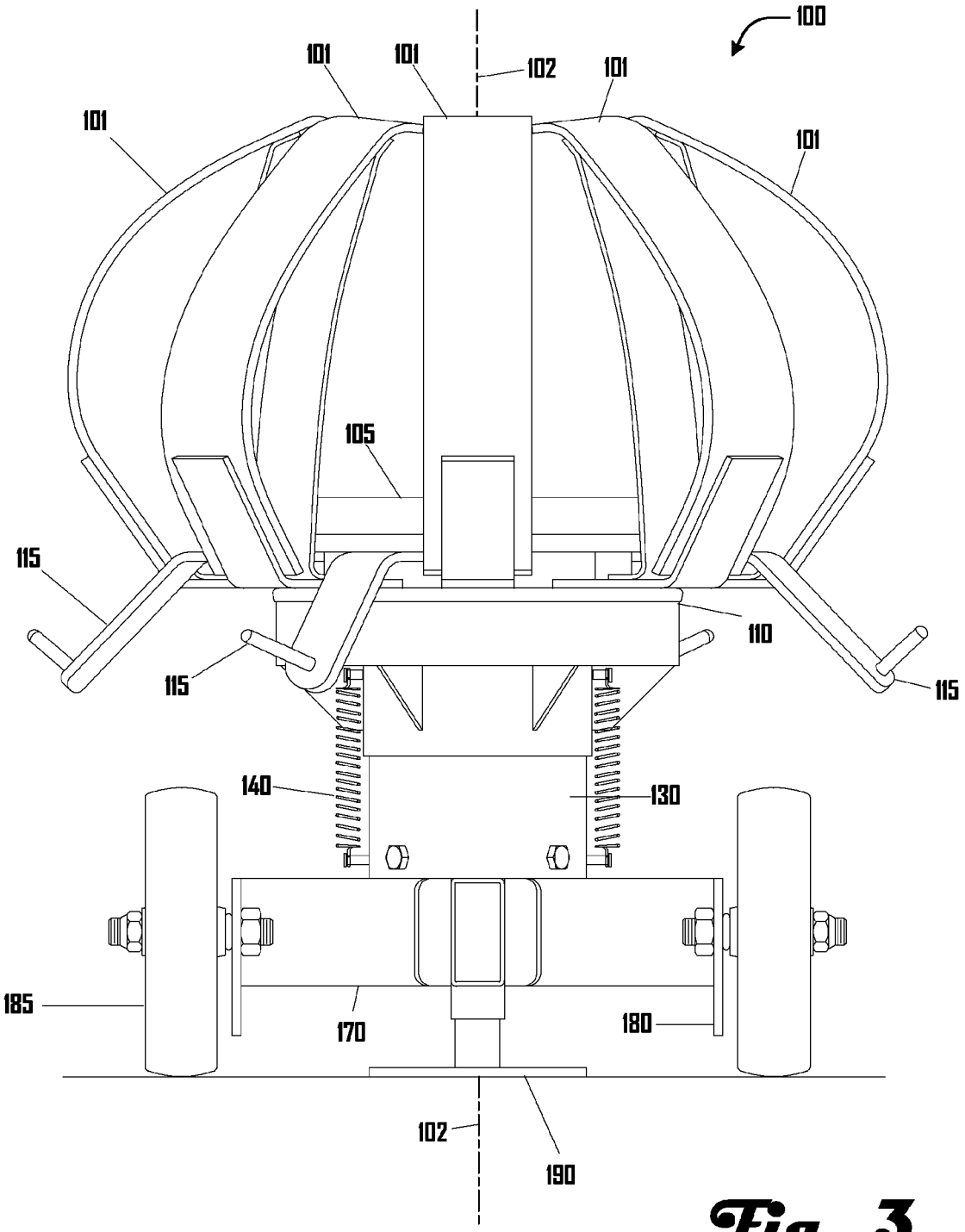
FIG. 3 illustrates an elevation view of the embodiment illustrated in FIG. 1, looking at the back end.

FIG. 3 illustrates an elevation view of the embodiment illustrated in FIG. 1, looking at the back end. This view illustrates the elements discussed in relation to FIGS. 1 and 2, and also shows an elevation view of the Hitch Mount 1401, discussed further below in relation to FIG. 14.

Figure 4:
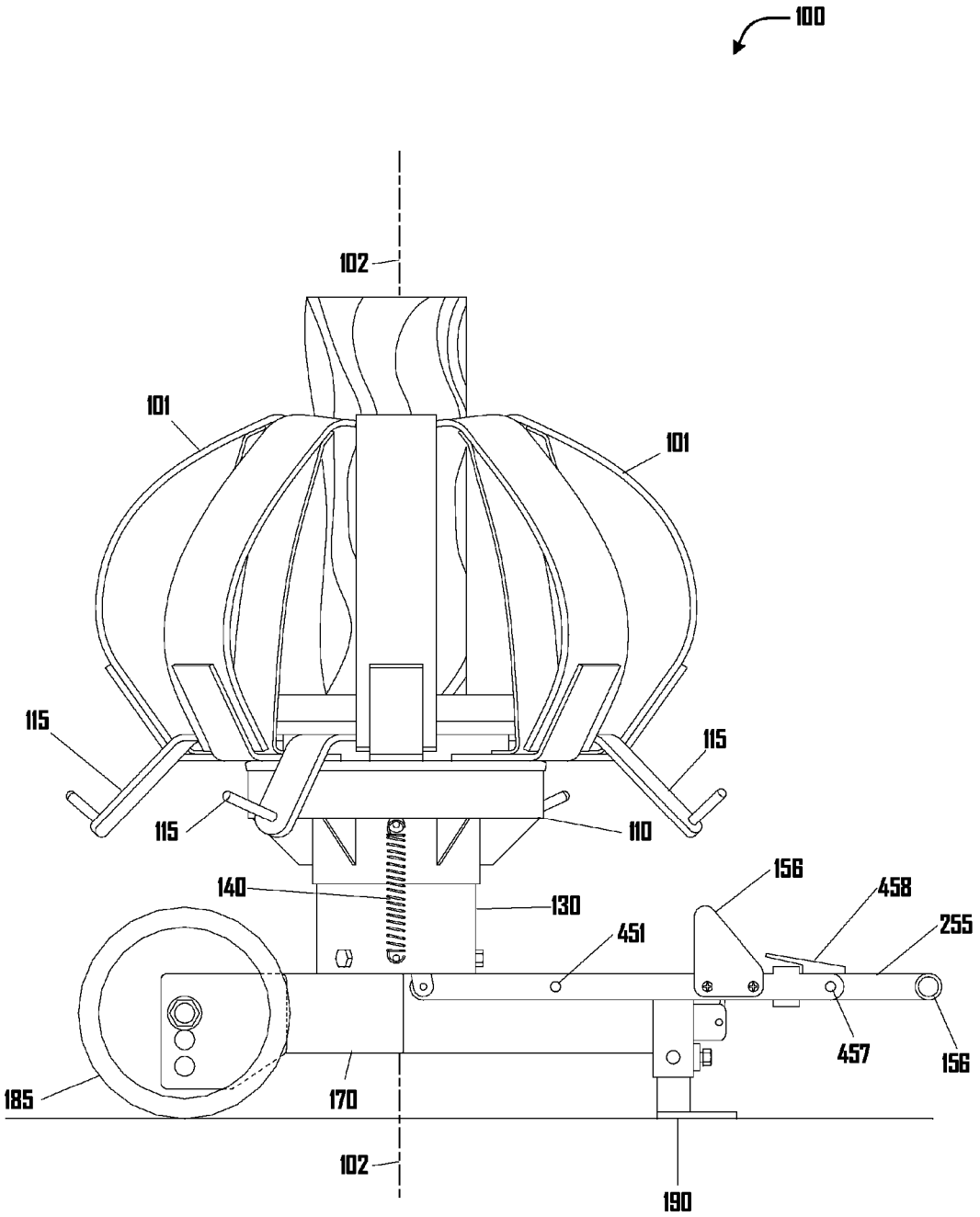
FIG. 4 illustrates an elevation view of the embodiment illustrated in FIG. 1, looking at the left side (right and left being assigned from the perspective of a user at the front end).
Figure 5:
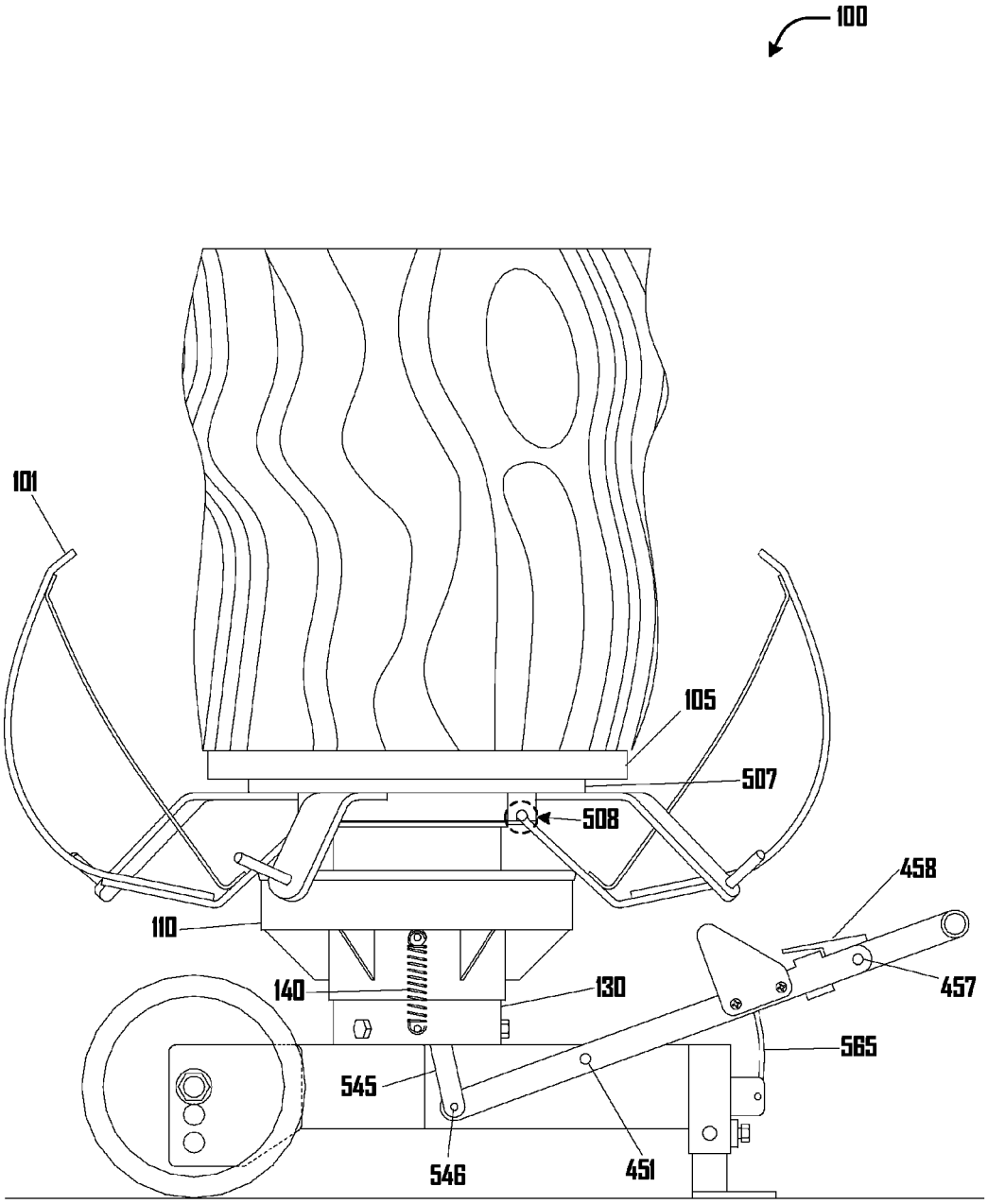
FIG. 5 illustrates an elevation view of the embodiment illustrated in FIG. 1, looking at the left side, with a log section, with the Fingers retracted, and with certain of the Fingers hidden.

FIG. 4 illustrates an elevation view of the embodiment illustrated in FIG. 1, looking at the left side (right and left being assigned from the perspective of a user at the front end, looking at the apparatus). This Figure calls out elements such as the Primary Lever Arm Axle 451, the Secondary Lever Arm Axle 457, and the Foot Switch 458. FIGS. 4 and 5 may be compared to illustrate motion of various of the components. Use of these components is discussed further herein.

FIG. 5 illustrates an elevation view of the embodiment illustrated in FIG. 1, looking at the left side, with a log section, with the Fingers retracted, and with certain of the Fingers and/or Outriggers hidden. This Figure calls out elements such as the Cross Bar Link 545, the Cross Bar Lever Arm Axle 546, the Latch Wedge Bar 565, and the Chopping Deck 507. The Cross Bar Link 545 may also be referred to as a "connecting rod." The Latch Wedge Bar 565 is attached to the Main Base 170 and comprises an arc section centered about the Primary Lever Arm Axle 451. The Fingers 101 may be joined to the Chopping Deck 507 at, for example, Finger Axles 508. The Finger Axles 508 are illustrated as axles with horizontally oriented axes of rotation tangential to the Chopping Surface 105 and allow the Fingers 101 to rotate up and down about the Finger Axles 508 around the perimeter of the Chopping Deck 507. In addition to Finger Axles 508, examples of such axles are illustrated in schematic form in FIG. 16B at element 1620, in FIG. 18B at element 1820, in FIG. 19B at element 1920, in FIG. 20B at element 2020, in FIG. 21B at element 2120, in FIG. 22B at element 2220, and in FIG. 23C at element 2320. The Finger Axles may comprise one or more rods welded or otherwise attached to the end of the Finger or Finger Mount (such as 2330), generally perpendicular to the long axis of the Finger and with a space between the rod and the main body of the end of the Finger or Finger Mount. The base of the Chopping Deck 507 may comprise an opening into which the rod may be inserted. A plate, cap, or similar may be attached, such as by welding, to the bottom of the opening, thereby holding the rod in the opening and forming the Finger Axle 508.

FIGS. 4 and 5 illustrate the mechanical relationship between the Lever Arm, the Cross Bar Link 545, the Control Ring 110, and the Fingers 101. These two Figures illustrate that the depressing the Lever Arm causes the Control Ring 110 to rise, which pushes up the Fingers 101 about the Finger Axles 508, which connects a log section to the Chopping Surface 105. Utilization of the Lever Arm to connect a log section to the Chopping Surface 105 is discussed further herein.

Figure 6:
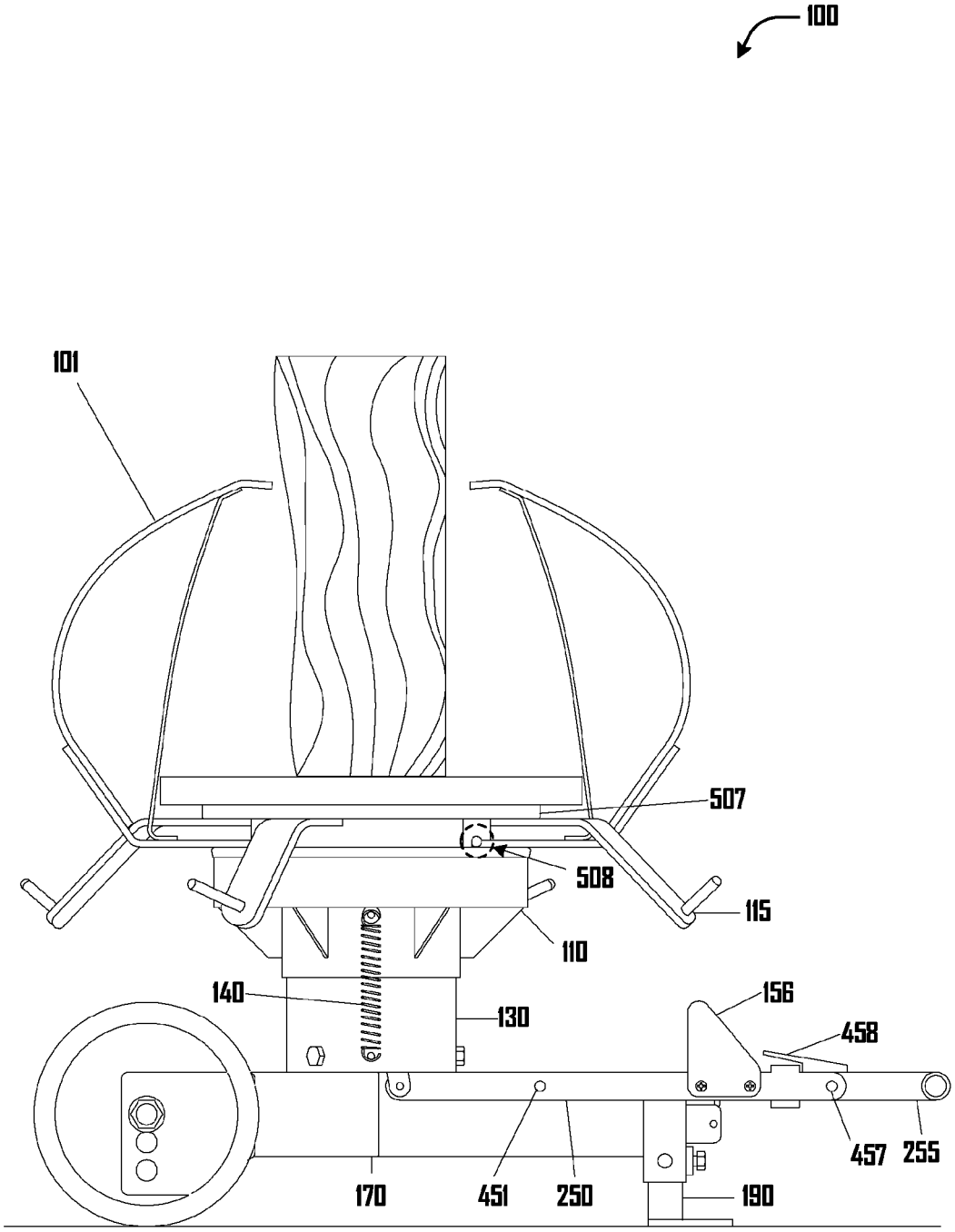
FIG. 6 illustrates an elevation view of the embodiment illustrated in FIG. 1, looking at the left side, with a log section, with the Fingers extended toward the log section, and with certain of the Fingers hidden.

FIG. 6 illustrates an elevation view of the embodiment illustrated in FIG. 1, looking at the left side, with a smaller log section than the log section illustrated in FIG. 5, with the Fingers extended toward the log section, the Lever Arms down and with certain of the Fingers hidden. The posture of the Lever Arms and the positions of the Fingers may be compared in FIGS. 5 and 6.

Figure 7:
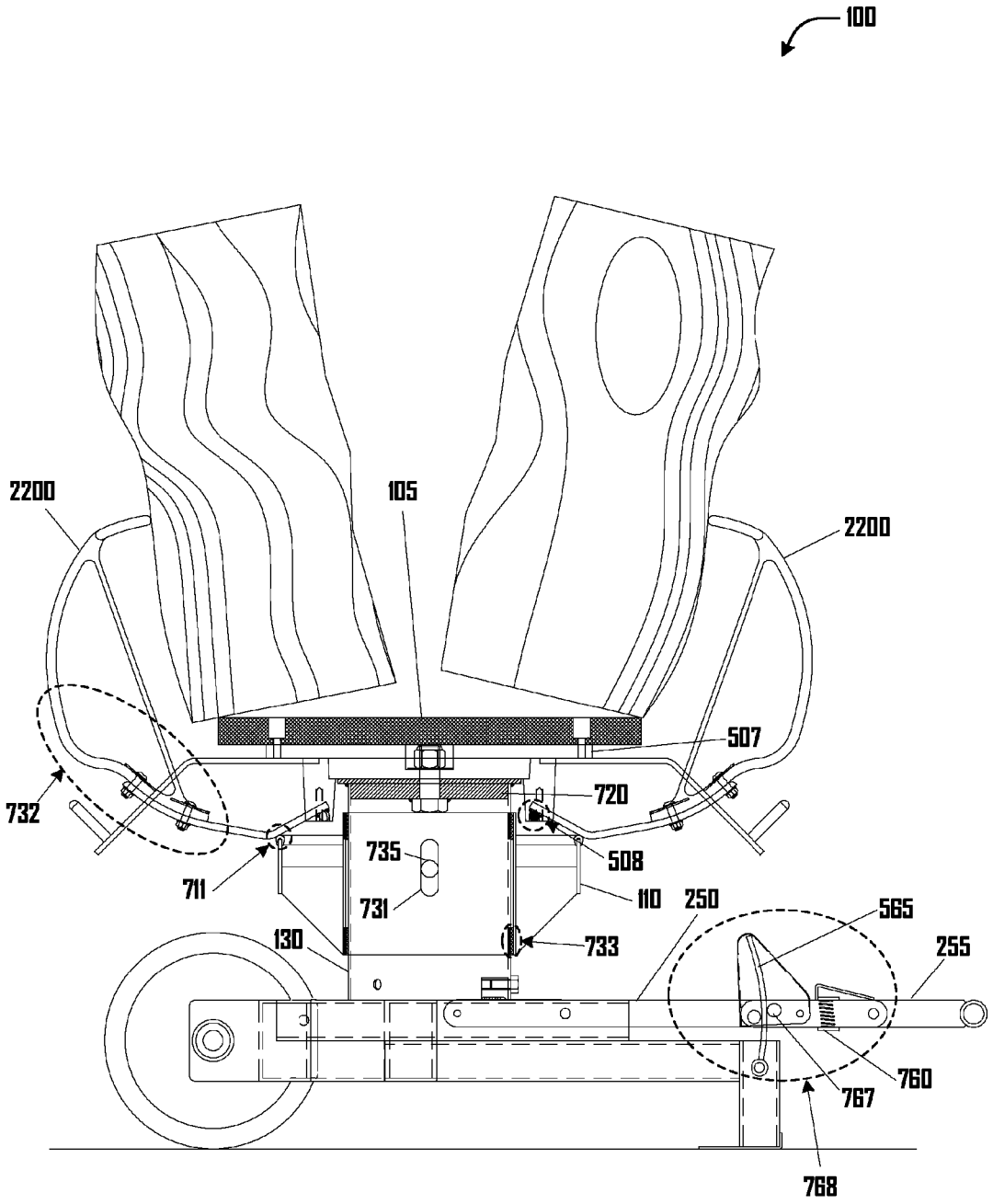
FIG. 7 illustrates an elevation view of an embodiment, with a section view of some components and some components hidden.

FIG. 7 illustrates an elevation view of an embodiment, with a section view of some components and some components hidden. This Figure illustrates a Low Fiction Surface 711 lining the top of the Control Ring 110 and in contact with the underside of the Fingers 101, a Channel 731, Bushings 733 between the Control Ring 110 and the Column 130, a Column Top Plate 720, a Latch Mechanism 768, and components within the Latch Mechanism 768, such as a Latch Wedge Bar 565, Latch Bind Rods 767, and a Latch Engage Spring 760. Use of these components is discussed further herein. This Figure also illustrates two separate log sections pressing out against Fingers 2200, causing deformation in Stress Transfer Area 732, the stress from the logs having been transferred to this area by the Tendon 2210 and Finger Mount 2230 (see FIG. 22 for additional detail and illustration of this Finger embodiment and FIGS. 18, 19, 20, 22, and 23 for additional Tendon embodiments). Such a configuration and result (two log sections, deformation of the Finger) is not anticipated or expected to be typical, but is provided to illustrate the function of the Tendon.

Figure 8:
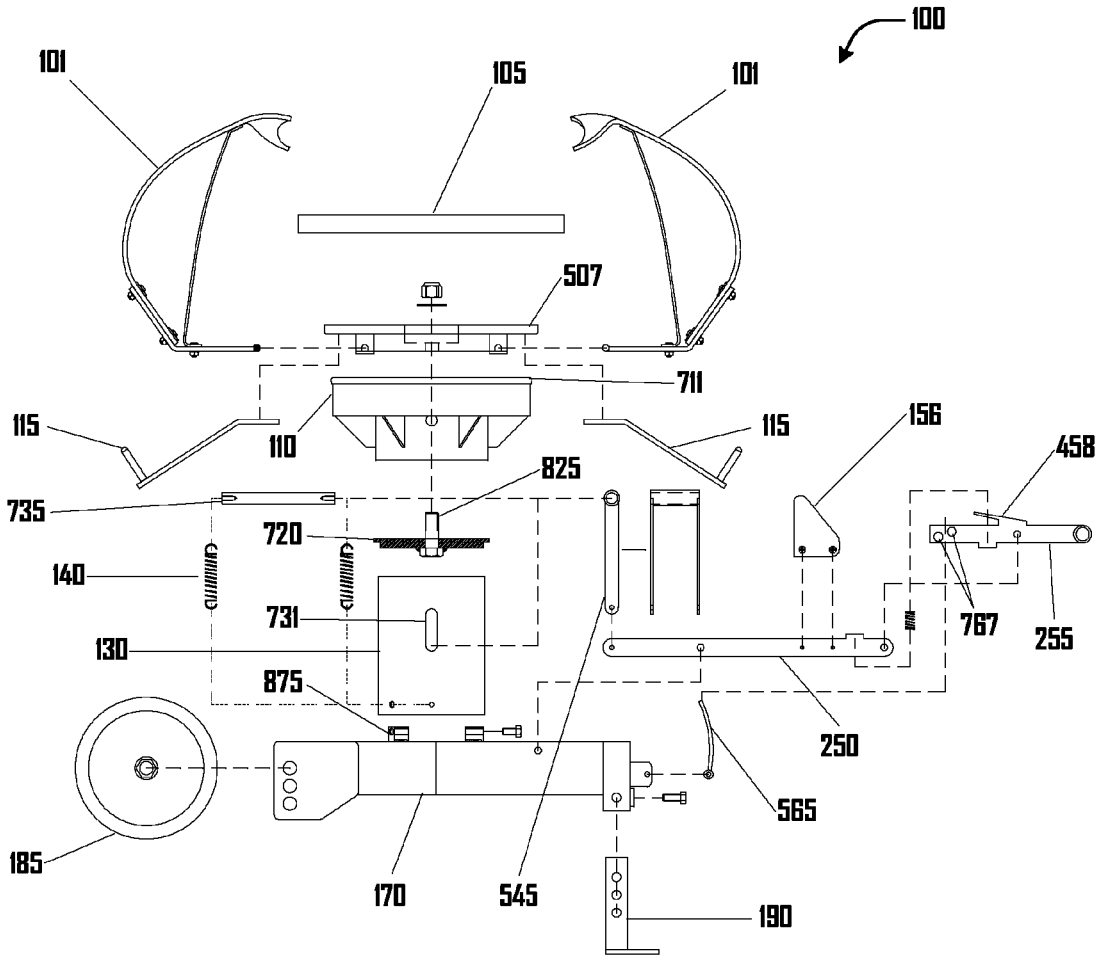
FIG. 8 illustrates an exploded elevation view of an embodiment, with dotted lines indicating the connection locations of some of the components.

FIG. 8 illustrates an exploded elevation view of an embodiment, with dotted lines indicating the join locations of some of the components. This Figure calls out a Control Ring Cross Bar 735 joining the Cross Bar Link 545 to the Control Ring 110, Column to Main Frame Mounts 875 joining the Column 130 to the Main Frame 170, and the Deck Pivot Shaft 825. The Chopping Surface 105, Chopping Deck 507, and Fingers 101 may be free to rotate about the central vertical axis of the Chopping Surface 105 and the Deck Pivot Shaft 825, when propelled by the Outriggers 115, this assembly being referred to as a "base." The bearing surface between the base and the Main Frame 170 may be, for example, between the Column Top Plate 720 attached to the Column 130 (neither of which rotate) and the Chopping Deck 507 (which does rotate); there may be a lubricated layer between the Column Top Plate 720 and the Chopping Deck 507, such as one or more Teflon® disks or other low-friction surfaces, with grease.

Figure 9:
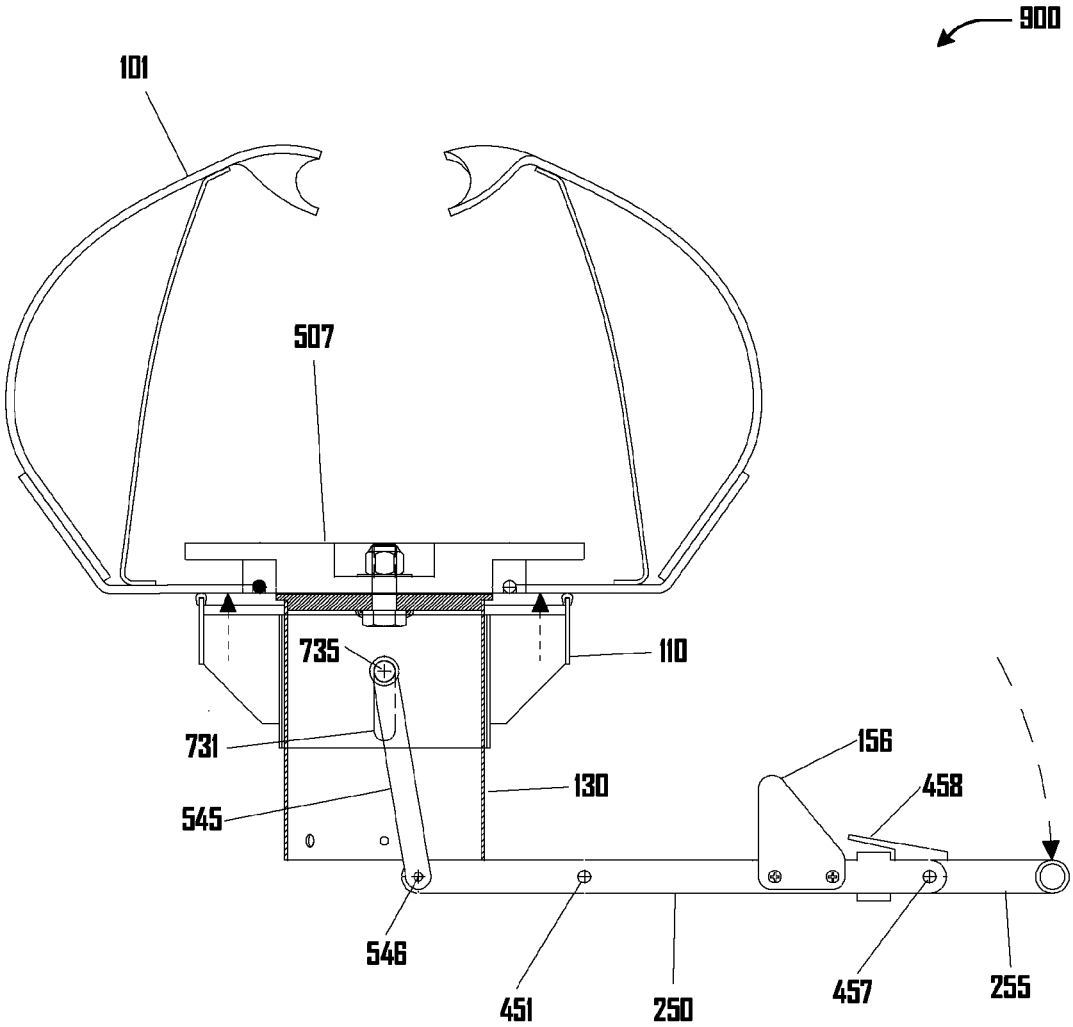
FIG. 9 illustrates a detail elevation view of some of the components, with the Fingers fully extended and lines indicating motion of some components.

FIG. 9 illustrates a detail elevation view of some of the components, with the Fingers fully extended, the Control Ring 110 up, and the Lever Arm down. FIG. 9 illustrates the Control Ring Cross Bar 735, which is attached to the Control Ring 110 and travels in Channel 731. FIGS. 9 through 12 show the relative motion of components and are discussed further below.

Figure 10:
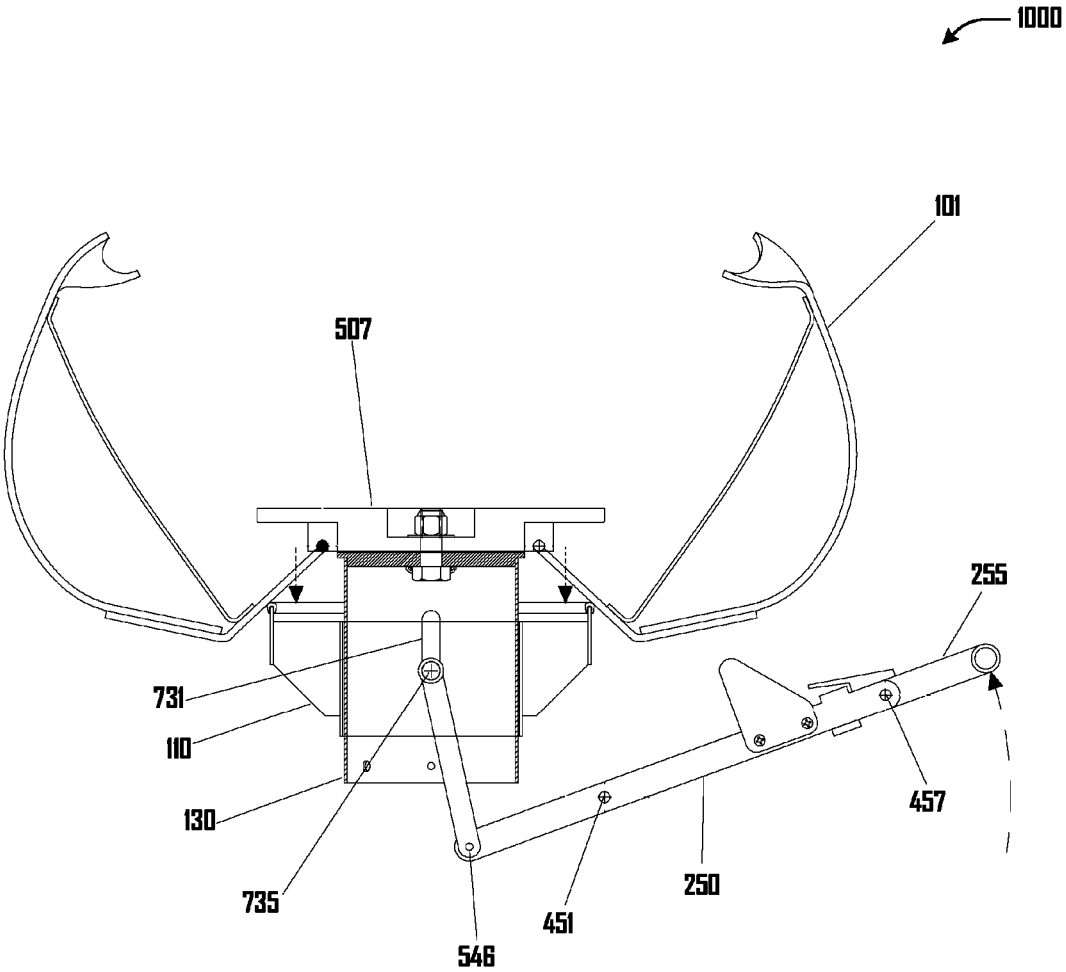
FIG. 10 illustrates the detail view of FIG. 10, with the Fingers retracted and lines indicating motion of some components.

FIG. 10 illustrates the detail view of FIG. 9, with the Fingers retracted and lines indicating motion of some components. FIGS. 9 through 12 show the relative motion of components and are discussed further below.

Figure 11:
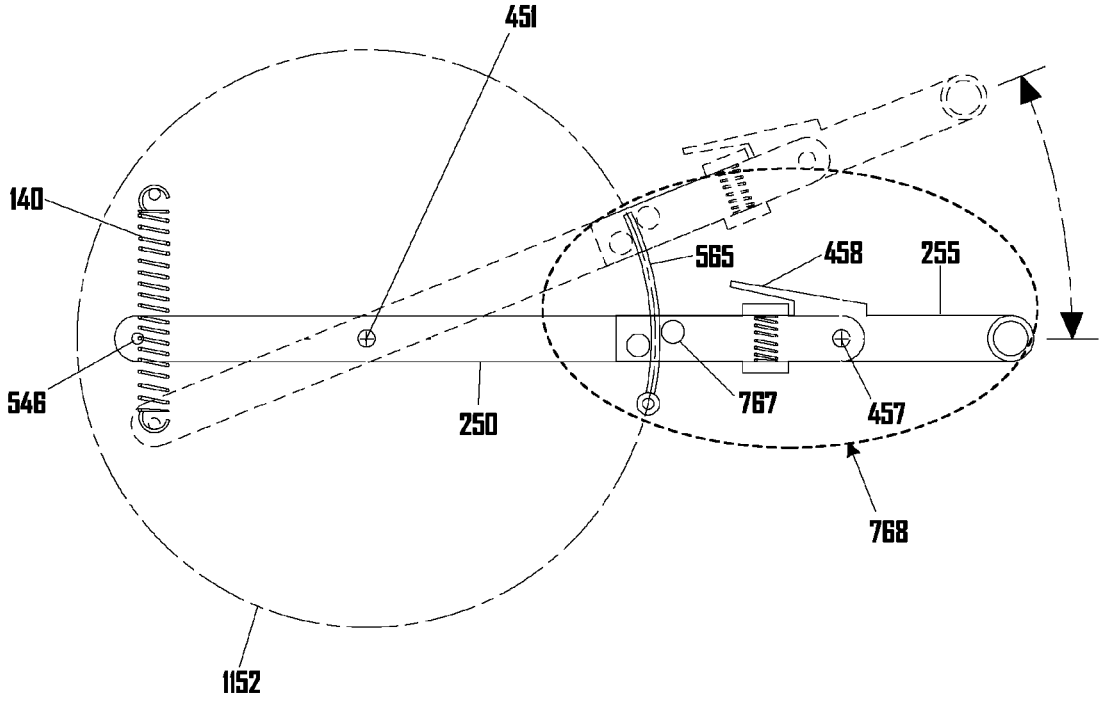
FIG. 11 illustrates a detail elevation view of a Primary Lever Arm, a Secondary Lever Arm, and a Latch, in a position in which the Fingers would be retracted, and with arrows indicating motion.

FIG. 11 illustrates a detail elevation view of the Primary Lever Arm 250, the Secondary Lever Arm 255, and the Latch Mechanism 768 in a first position in which the Fingers (if illustrated) would be extended. The arrows in FIG. 11 indicate motion to a second position (with components illustrated with dotted lines) in which the Fingers would be retracted. In both positions the Primary Lever Arm 250 and Secondary Lever Arm 255 are illustrated as being aligned, which causes the Latch Mechanism 768 not to be locked. Ring 1152 illustrates that the Primary Lever Arm 250 (and joined components) may rotate about the Primary Lever Arm Axle 451 and that Latch Wedge Bar 565 is an arc section centered around the Primary Lever Arm Axle 451. FIGS. 9 through 12 show the relative motion of components and are discussed further below.

Figure 12:
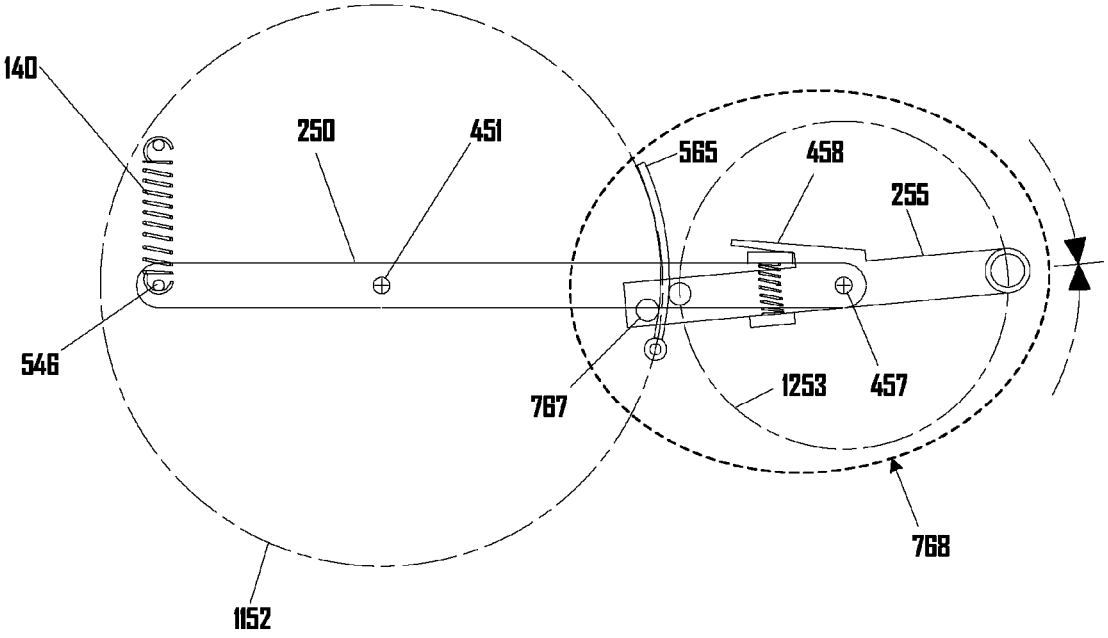
FIG. 12 illustrates a detail elevation view of the view illustrated in FIG. 12, in a position in which the Fingers would be extended.

FIG. 12 illustrates a detail elevation view of the view illustrated in FIG. 11, in a position in which the Fingers would be extended, and with arrows indicating potential motion of the Secondary Lever Arm 255 about the Secondary Lever Arm Axle 457. As illustrated in this Figure, the Secondary Lever Arm 255 and Primary Lever Arm 250 are not aligned, the Secondary Lever Arm 255 is rotated about the Secondary Lever Arm Axle 457, and the Latch Mechanism 768 is locked. Ring 1253 illustrates that the Secondary Lever Arm 255 may rotate about the Secondary Lever Arm Axle 457. FIGS. 9 through 12 show the relative motion of components and are discussed further below.

Extension and retraction of the Fingers 101 in an embodiment is as follows: The user applies downward pressure on the Foot Actuator 157. The user must apply enough downward pressure to overcome the Latch Engage Spring 760 and to rotate the Secondary Lever Arm 255 about the Secondary Lever Arm Axle 457, which increases the distance between the Latch Bind Rods 767, relative to the Latch Wedge Bar 565, and allows the Latch Bind Rods 767 to rotate up and down, relative to the Latch Wedge Bar 565 (which Latch Wedge Bar 565 is attached to the Main Frame 170). While applying this downward pressure, the user either increases the pressure, to push the Foot Actuator 157 down or decreases pressure, allowing the Foot Actuator 157 to rise. Pushing the Foot Actuator 157 down causes the Finger Control Ring 110 to rise because the Secondary Lever Arm 255 is attached to the Primary Lever Arm 250, which is attached to the Main Frame 170 at the Primary Lever Arm Axle 451 and is attached, via the Cross Bar Link 545 and the Control Ring Cross Bar 735, to the Finger Control Ring 110; the Finger Control Ring 110 (and Low Friction Surface 711) pushes against the bottom of the Fingers 101, which extends the Fingers 101 up (rotating them about the Finger Axles (508)) and toward the Center 102 of the Chopping Surface 105. The Finger Control Ring 110 may comprise a Low-Friction Surface 711 on the top of the Finger Control Ring 110. Allowing the Foot Actuator 157 to rise (while maintaining downward pressure) allows the Finger Control Ring 110 to descend, which retracts the Fingers 101 away from the center of the Chopping Surface 105. The Foot Actuator 157 rises because the weight of the Finger Control Ring 110 and because the Control Ring Return Spring 140 are both exerting downward forces, via the Cross Bar Link 545, on the distal end of the Primary Lever Arm 250 (distal relative to the Foot Actuator 157). When the Foot Actuator 157 and the Secondary Lever Arm 255 are rapidly released (when the downward pressure is discontinued), friction between the Latch Bind Rods 767 and the Latch Wedge bar 565, the force provided by the Latch Engage Spring 760, and any force provided by the user in tapping (with, for example, a toe of a foot) on the Foot Switch 458 will cause the Secondary Lever Arm 255 to rotate about the Secondary Lever Arm Axle 457 and to decrease the effective distance between the Latch Bind Rods 767 relative to the Latch Wedge Bar 565, causing the Latch Bind Rods 767 to compress the Latch Wedge Bar 565 between them, securing the Fingers 101 at approximately the then-current state of extension. Friction between the Latch Bind Rods 767 and the Latch Wedge Bar 565 biases the Secondary Lever Arm 255 to rotate further about the Secondary Lever Arm Axle 457, increasing compression of the Latch Bind Rods 767 relative to the Latch Wedge Bar 565 and further securing the then-current state of extension. In addition to other of the Figures, FIGS. 9 through 12 illustrate these components and this process. The Latch Bind Rods 767 and/or Latch Wedge Bar 565 may be fabricated from hardened steel, including hardened stainless steel, to accommodate the forces experienced by these components.

Figure 13A:
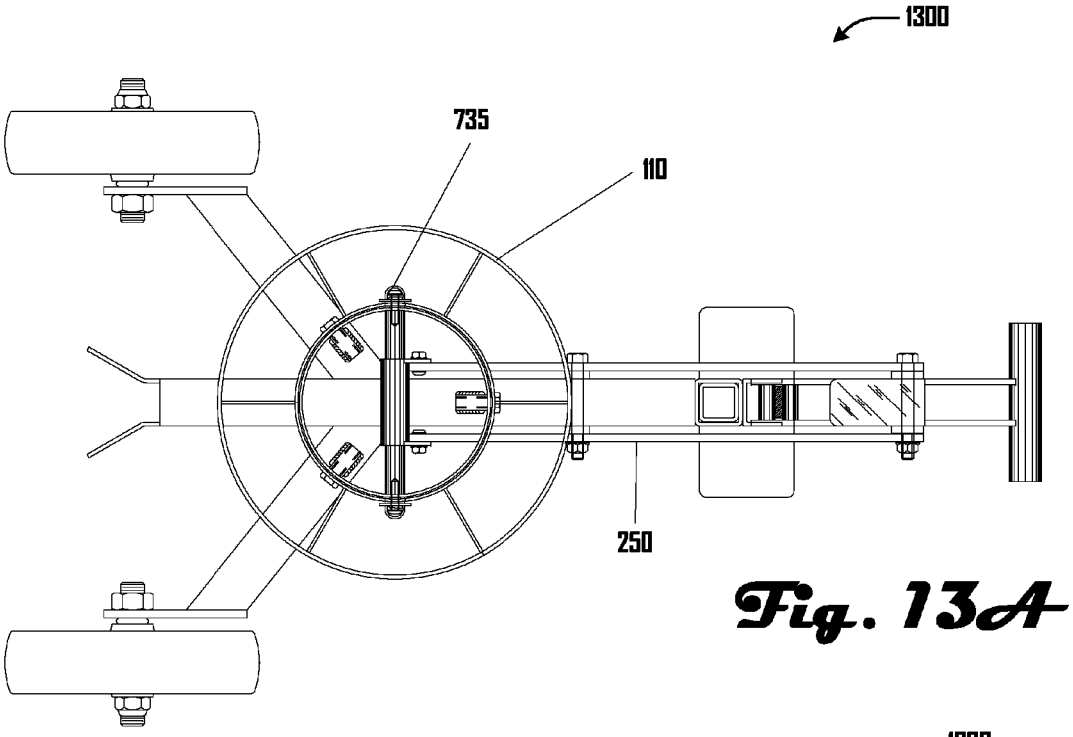
FIG. 13A illustrates a top plan view of the embodiment illustrated in FIG. 1, with components hidden.
Figure 13B:
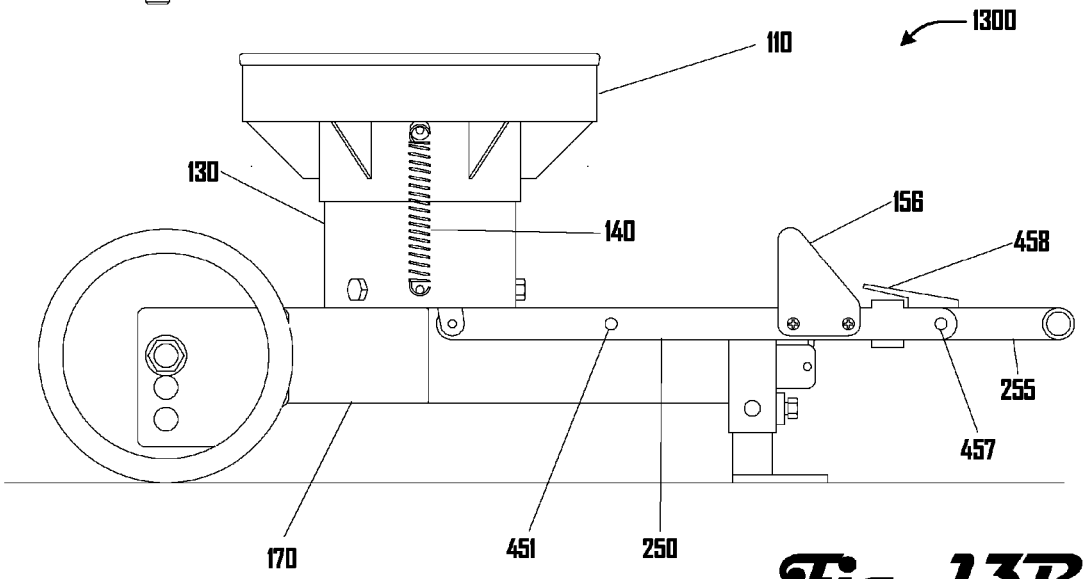
FIG. 13B illustrates a left elevation view of the view illustrated in FIG. 13A.

FIG. 13A illustrates a top plan view of the embodiment illustrated in FIG. 1, with components hidden. FIG. 13B illustrates a left elevation view of the view illustrated in FIG. 13A. These Figures illustrate these components in isolation to clarify the structural relationship among the components.

Figure 14:
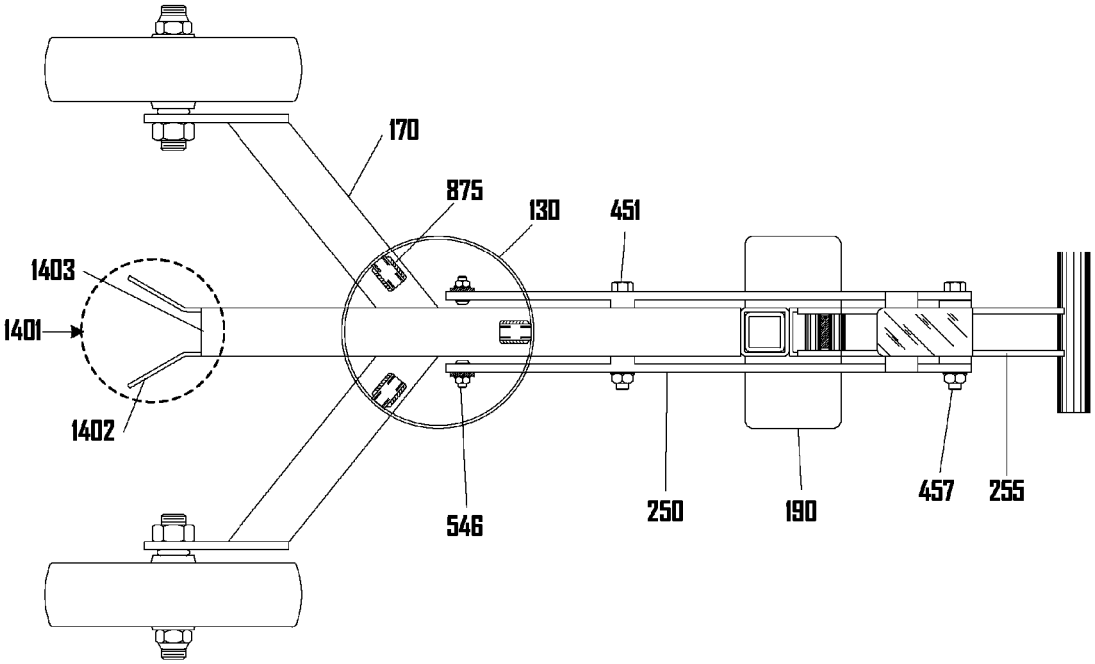
FIG. 14 illustrates a top plan view of the embodiment illustrated in FIG. 1, with components hidden.

FIG. 14 illustrates a top plan view of the embodiment illustrated in FIG. 1, with components hidden. FIG. 14 calls out a Hitch Mount 1401, which may be a structure to which a hitch may be mounted, to allow the Splitting Assistance Apparatus 100 to be connected or attached to a hitch on a vehicle, to allow convenient transportation of the Apparatus. The Hitch Mount 1401 comprises Guide Arms 1402 and Hitch Opening 1403, which may be an opening in the structure of the Main Frame 170. The Hitch Mount 1401 may receive a projection which corresponds to the Hitch Opening 1403. The received projection may be part of a hitch attached to a vehicle. The received projection may comprise an axle with a locking mechanism, to allow the projection to rotate about the axle and to then lock the projection in a more upright posture. The Splitting Assistance Apparatus 100 may be mounted on the projection, a cotter pin or similar passed through corresponding holes in the Hitch Mount 1401 and the projection (to join them together), and the Splitting Assistance Apparatus 100 may be lifted up while connected to the projection, with the projection's axle then locked to hold the Splitting Assistance Apparatus 100 in the more upright posture, allowing the Splitting Assistance Apparatus 100 to be transported on the projection and vehicle hitch to which the projection may be attached.

Figure 15:
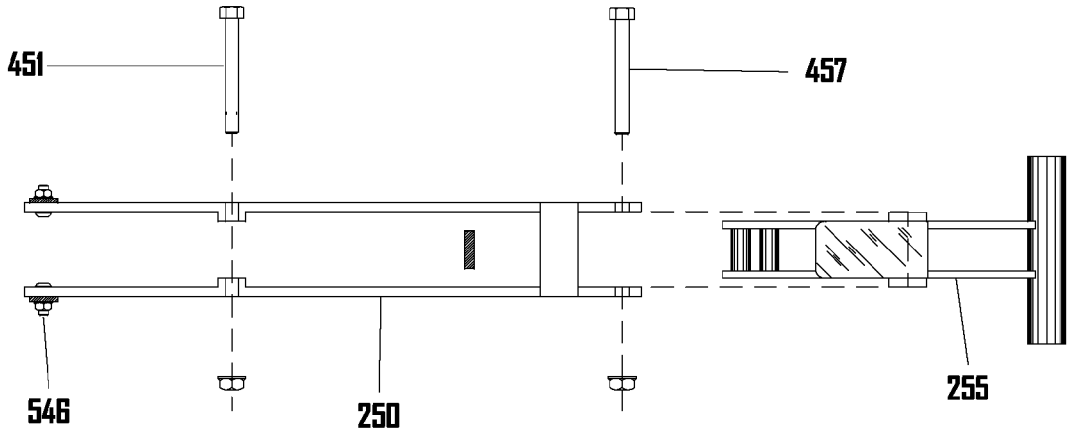
FIG. 15 illustrates a top plan view of exploded components of an embodiment of a Primary Lever arm and a Secondary Lever arm.

FIG. 15 illustrates a top plan view of exploded components of an embodiment of a Primary Lever arm and a Secondary Lever arm. These Figures illustrate these components in isolation to clarify the structural relationship among the components.

FIGS. 16A through 28 illustrate Finger embodiments. These embodiments are discussed at greater length herein.

Figure 16A:
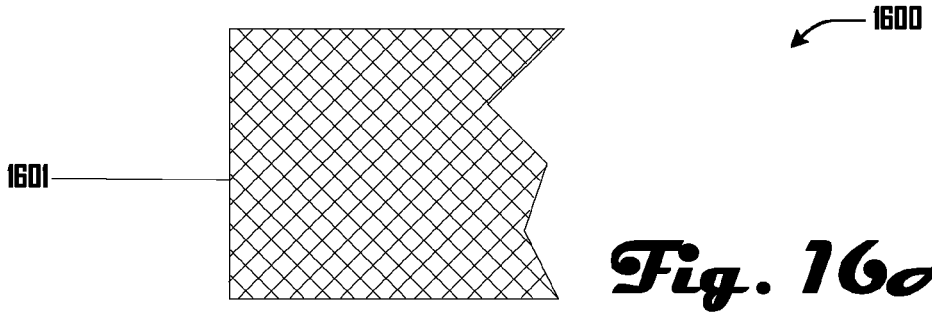
FIG. 16A illustrates a top plan view of a Finger embodiment.
Figure 16B:
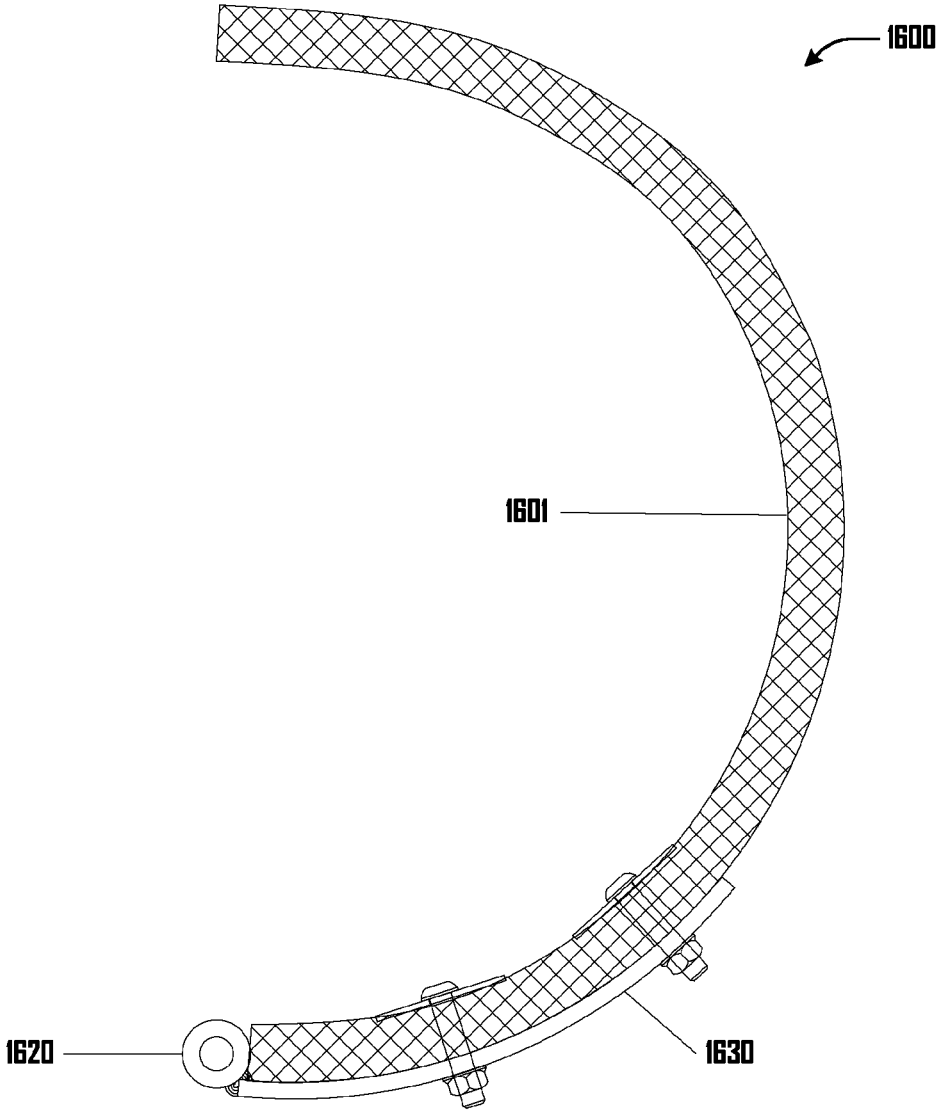
FIG. 16B illustrates a side elevation view of the Finger embodiment illustrated in FIG. 16A.

FIG. 16A illustrates a top plan view of a Finger embodiment 1600. FIG. 16B illustrates a side elevation view of the Finger embodiment illustrated in FIG. 16A. Illustrated is a Finger Axle 1620, a Finger Mount 1630, and the Finger Structure 1601, which comprise the Finger 1600 embodiment.

Figure 17A:
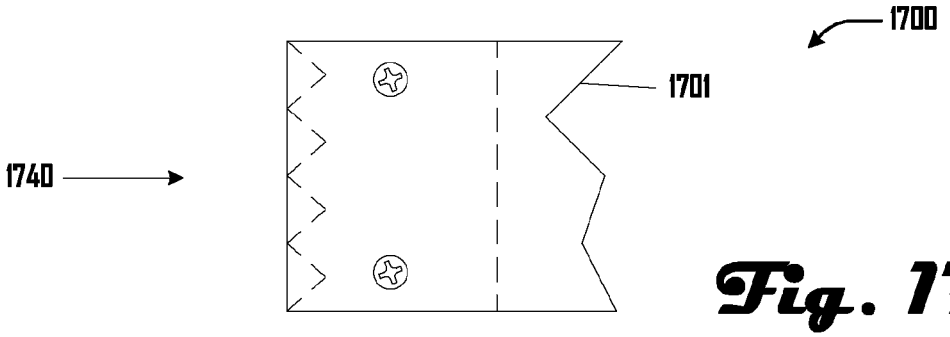
FIG. 17A illustrates a top plan view of a Finger embodiment.
Figure 17B:
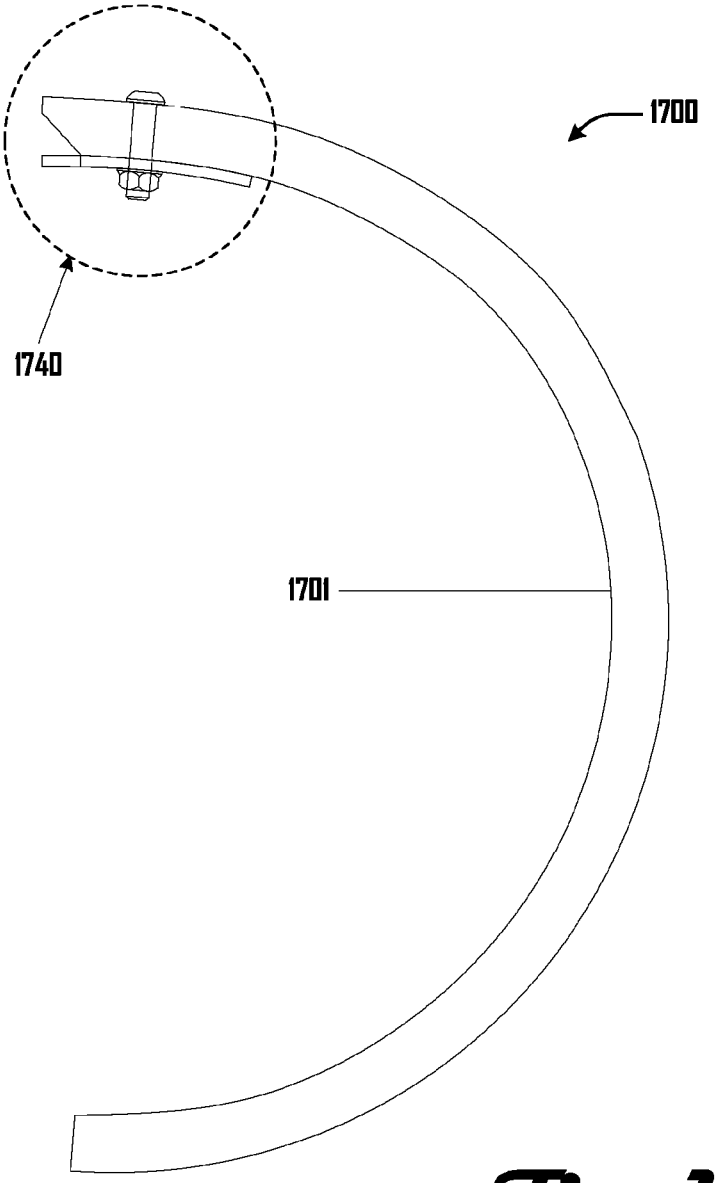
FIG. 17B illustrates a side elevation view of the Finger embodiment illustrated in FIG. 17A.

FIG. 17A illustrates a top plan view of a Finger 1700 embodiment. FIG. 17B illustrates a side elevation view of the Finger embodiment illustrated in FIG. 17A. Illustrated is a Finger Nail 1740, provided to increase friction with a log section. The Finger Nail 1740 may be made of a metal, such as iron, steel, or stainless steel.

Figure 18A:
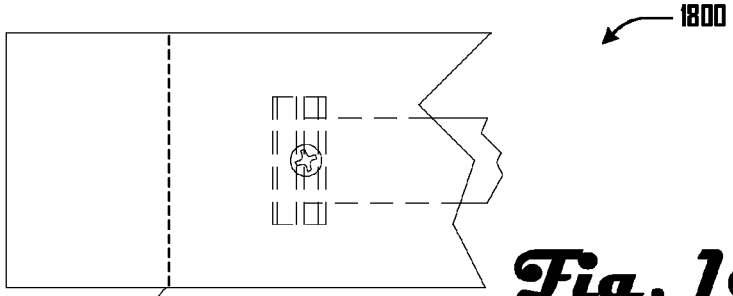
FIG. 18A illustrates a top plan view of a Finger embodiment.
Figure 18B:
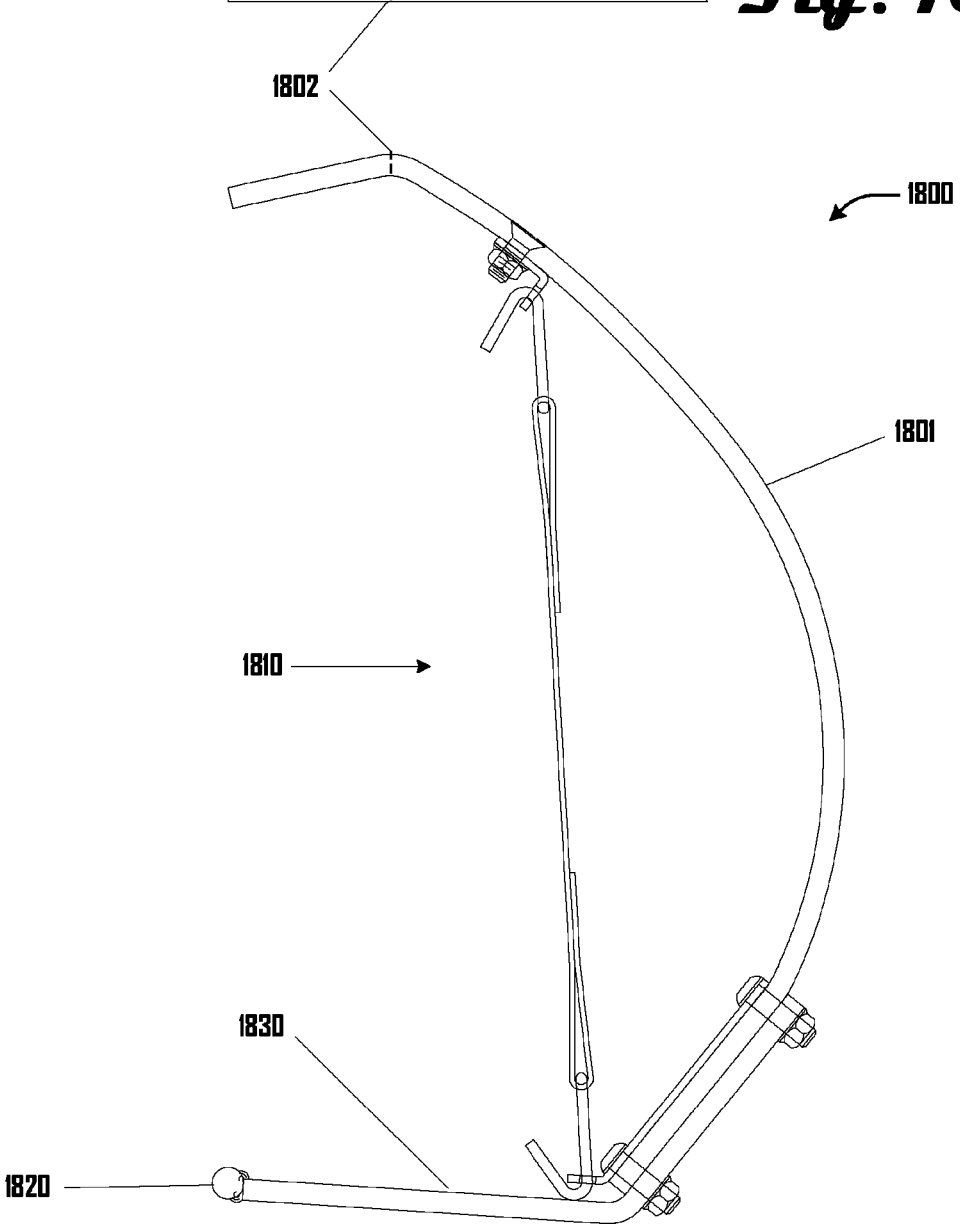
FIG. 18B illustrates a side elevation view of the Finger embodiment illustrated in FIG. 18A.

FIG. 18A illustrates a top plan view of a Finger 1800 embodiment. FIG. 18B illustrates a side elevation view of the Finger embodiment illustrated in FIG. 18A. These Figures illustrate a Tendon 1810, comprising a strap, mounting hardware and bolts to mount the Tendon to the Finger 1800. These Figures also illustrate a Finger Mount 1830, to which a Finger Structure 1801 and the Tendon 1810 may be attached. These Figures also illustrate a Finger Axle 1820 in schematic form.

Figure 19A:
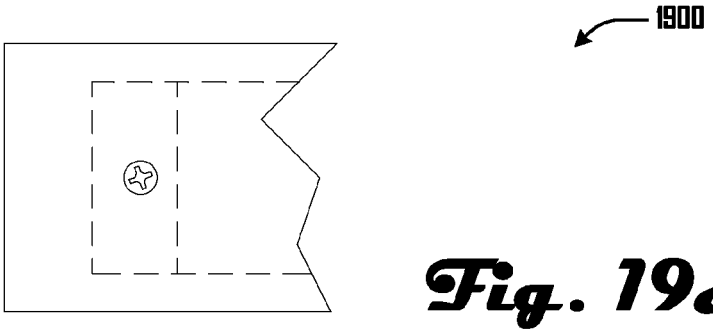
FIG. 19A illustrates a top plan view of a Finger embodiment.
Figure 19B:
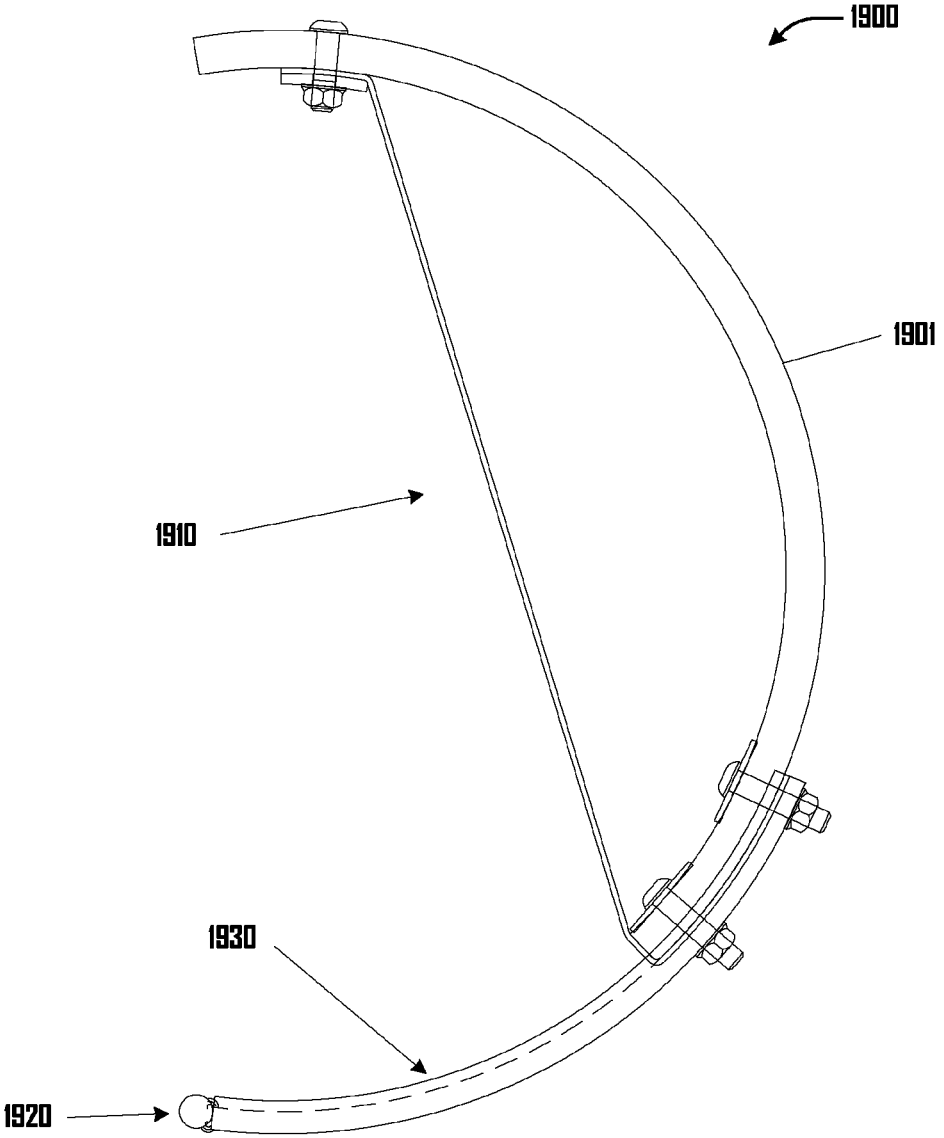
FIG. 19B illustrates a side elevation view of the Finger embodiment illustrated in FIG. 19A.

FIG. 19A illustrates a top plan view of a Finger 1900 embodiment. FIG. 19B illustrates a side elevation view of the Finger embodiment illustrated in FIG. 19A. These Figures illustrate a Tendon 1910, comprising a strap, mounting hardware and bolts to mount the Tendon to the Finger 1900. These Figures also illustrate a Finger Mount 1930, to which a Finger Structure 1901 and the Tendon 1810 may be attached. These Figures also illustrate a Finger Axle 1920 in schematic form.

Figure 20A:
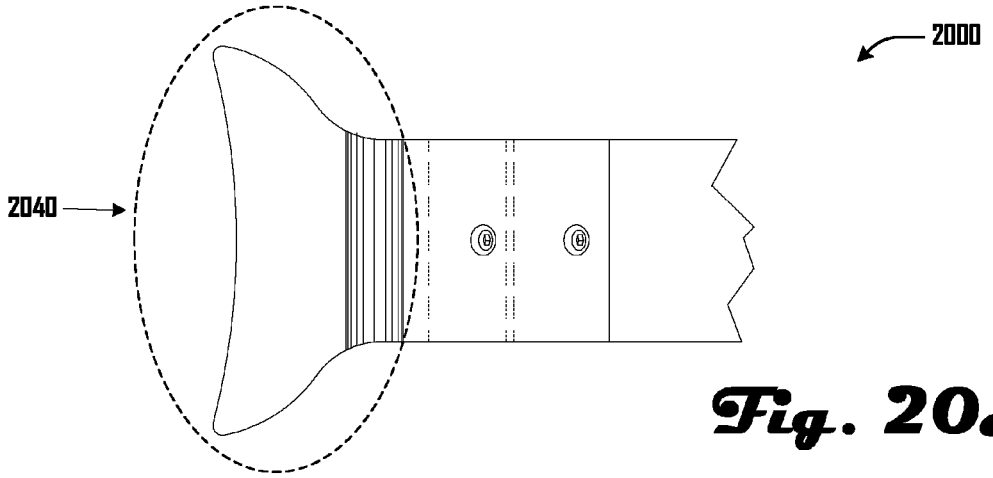
FIG. 20A illustrates a top plan view of a Finger embodiment.
Figure 20B:
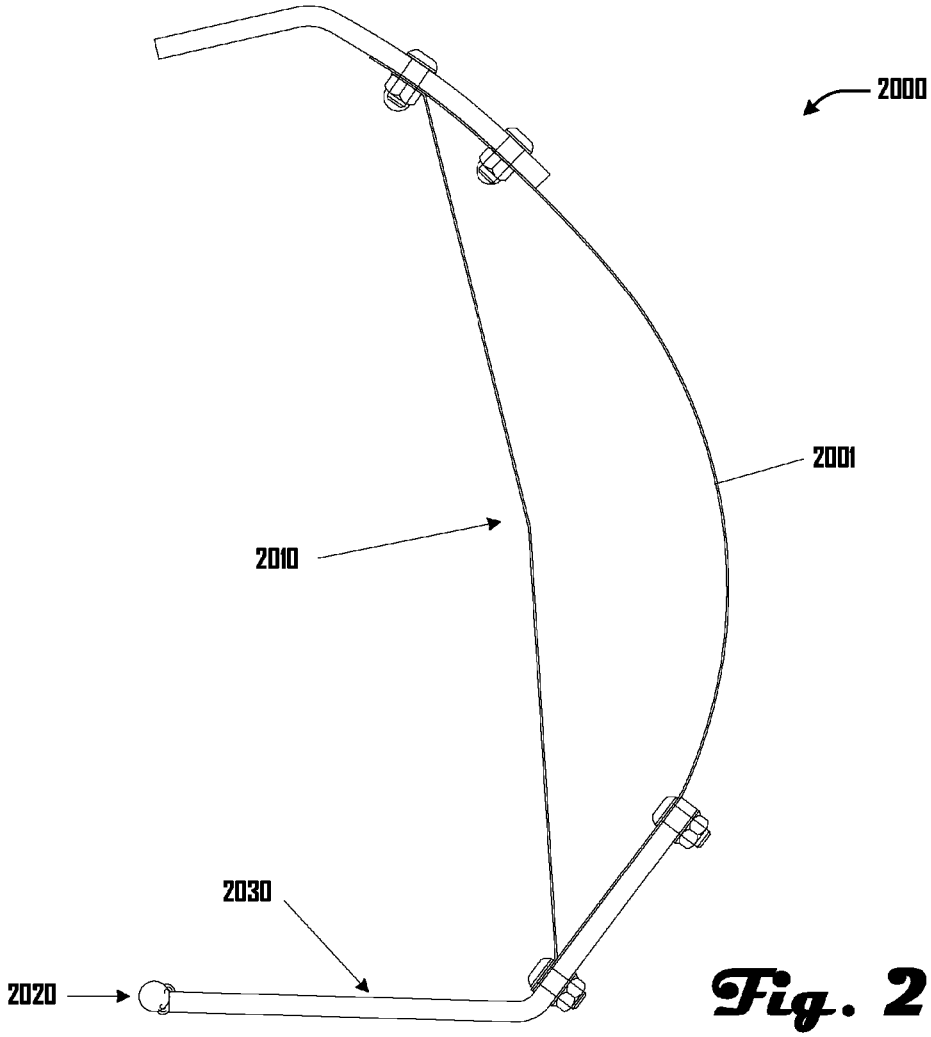
FIG. 20B illustrates a side elevation view of the Finger embodiment illustrated in FIG. 20A.

FIG. 20A illustrates a top plan view of a Finger 2000 embodiment. FIG. 20B illustrates a side elevation view of the Finger embodiment illustrated in FIG. 20A. These Figures illustrate a Tendon 2010, comprising a strap, mounting hardware and bolts to mount the Tendon to the Finger 2000. These Figures also illustrate a Finger Mount 2030, to which a Finger Structure 2001 and the Tendon 2010 may be attached. The Finger Structure 2001 illustrated in these Figures is a relative slender structure (compared to other Finger Structures illustrated herein). These Figures also illustrate a Finger Axle 2020 in schematic form.

Figure 21A:
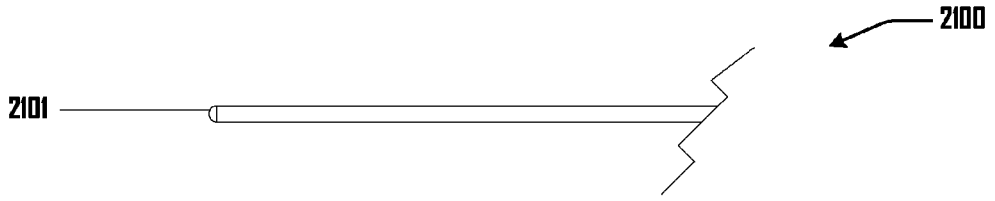
FIG. 21A illustrates a top plan view of a Finger embodiment.
Figure 21B:
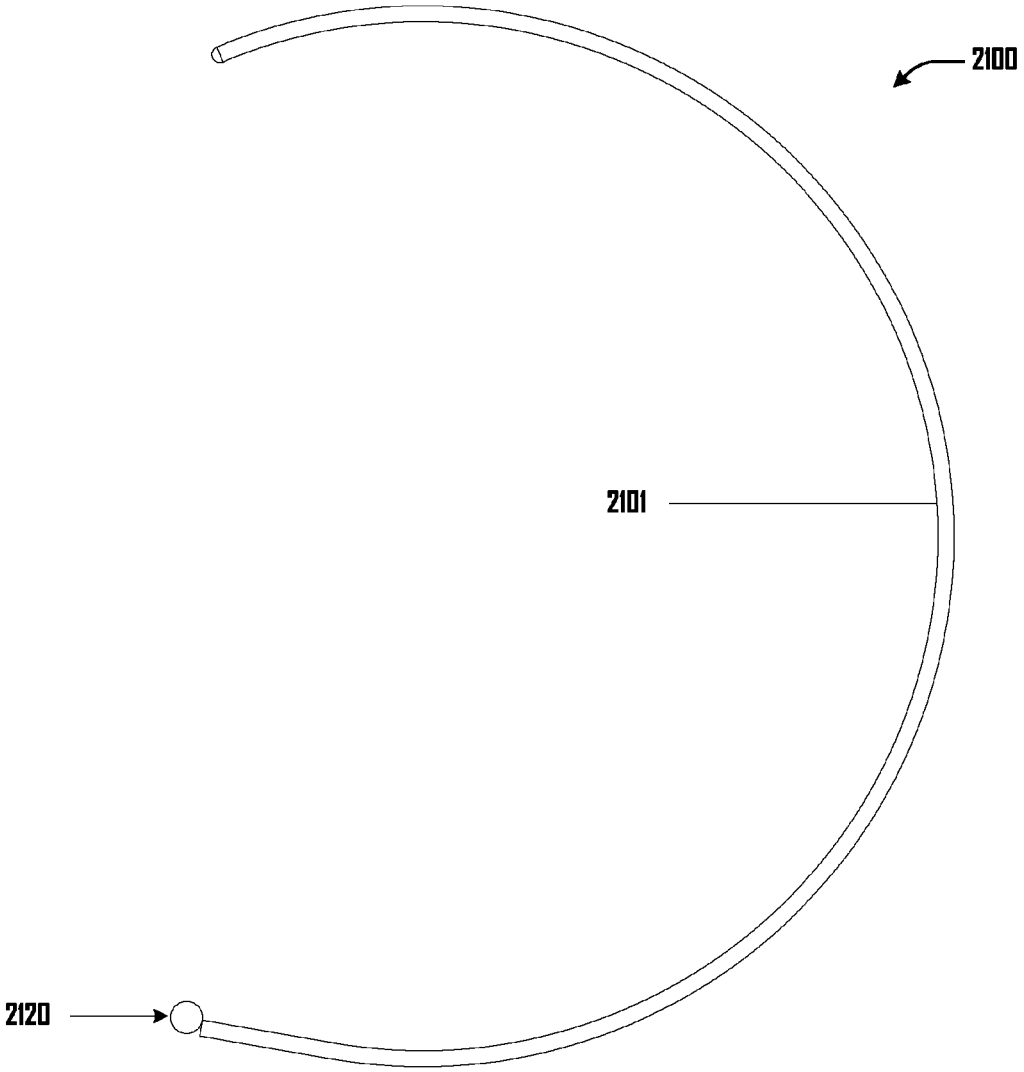
FIG. 21B illustrates a side elevation view of the Finger embodiment illustrated in FIG. 21A.
Figure 27A:
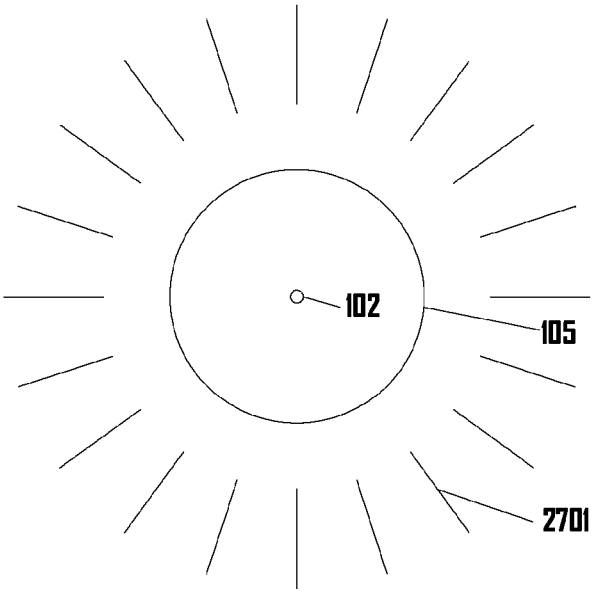
FIG. 27A illustrates a top plan schematic view of a Finger embodiment with Fingers extended.
Figure 27B:
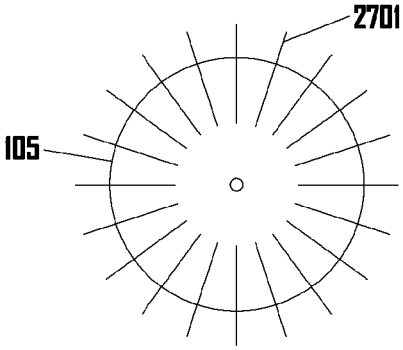
FIG. 27B illustrates a top plan schematic view of the Finger embodiment illustrated in FIG. 27A with Fingers retracted.

FIG. 21A illustrates a top plan view of a Finger 2100 embodiment. FIG. 21B illustrates a side elevation view of the Finger embodiment illustrated in FIG. 21A. These Figures illustrate a Finger Structure 2101 which is a relatively slender and narrow structure, such as a curved piece of spring sheet steel. These Figures also illustrate a Finger Axle 2120 in schematic form. The Finger 2100 embodiment illustrated in FIGS. 21A and 21B would be part of an array of a relatively large number of Fingers, as illustrated in FIGS. 27A and 27B. When accidentally struck from above, the axe would typically pass between the Fingers 2100 because they are narrow.

Figure 22A:
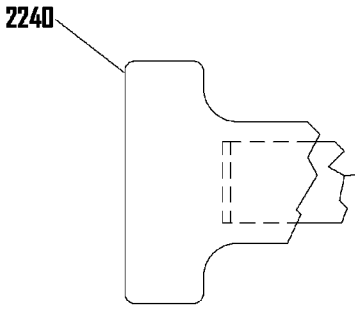
FIG. 22A illustrates a top plan view of a Finger embodiment.
Figure 22B:
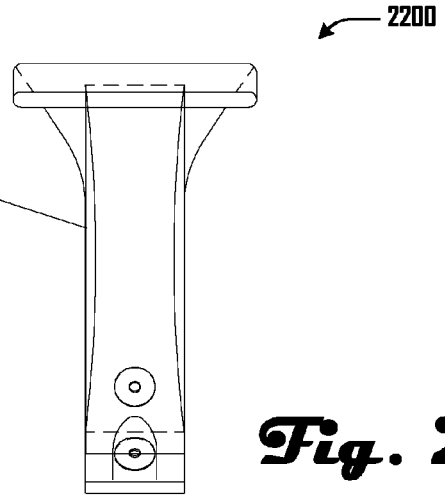
FIG. 22B illustrates a front elevation view of the Finger embodiment illustrated in FIG. 22A.
Figure 22C:
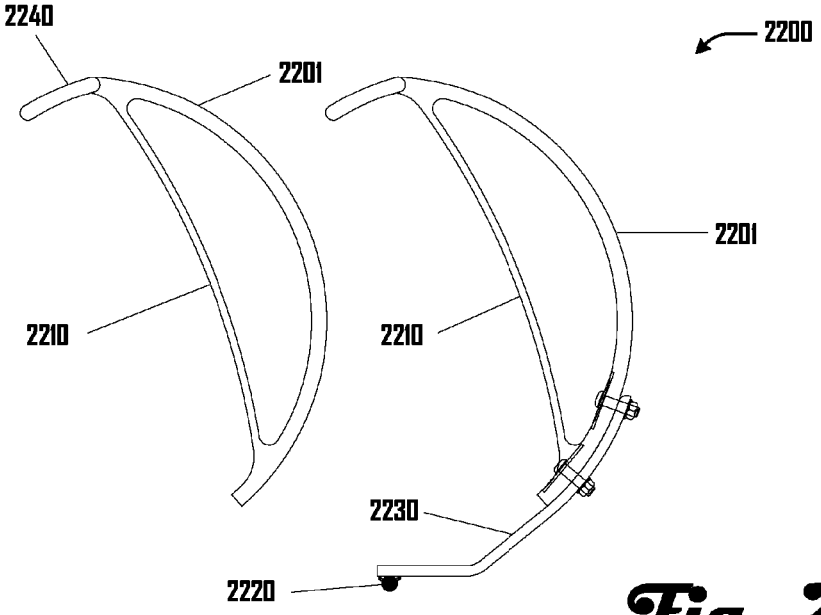
FIG. 22C illustrates a side elevation view of the Finger embodiment illustrated in FIG. 22A.

FIG. 22A illustrates a top plan view of a Finger 2200 embodiment. FIG. 22B illustrates a front elevation view of the Finger embodiment illustrated in FIG. 22A. FIG. 22C illustrates a side elevation view of the Finger embodiment illustrated in FIG. 22A. These Figures illustrate a Fingertip 2240 which is wider than the Finger Structure 2201, in addition to a Tendon 2210, Finger Structure 2201, Finger Mount 2230, and Finger Axle 2220.

Figure 23A:
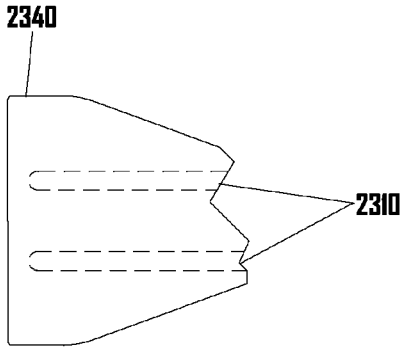
FIG. 23A illustrates a top plan view of a Finger embodiment.
Figure 23B:
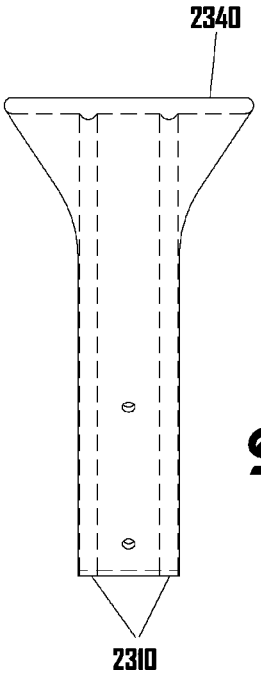
FIG. 23B illustrates a front elevation view of the Finger embodiment illustrated in FIG. 23A.
Figure 23C:
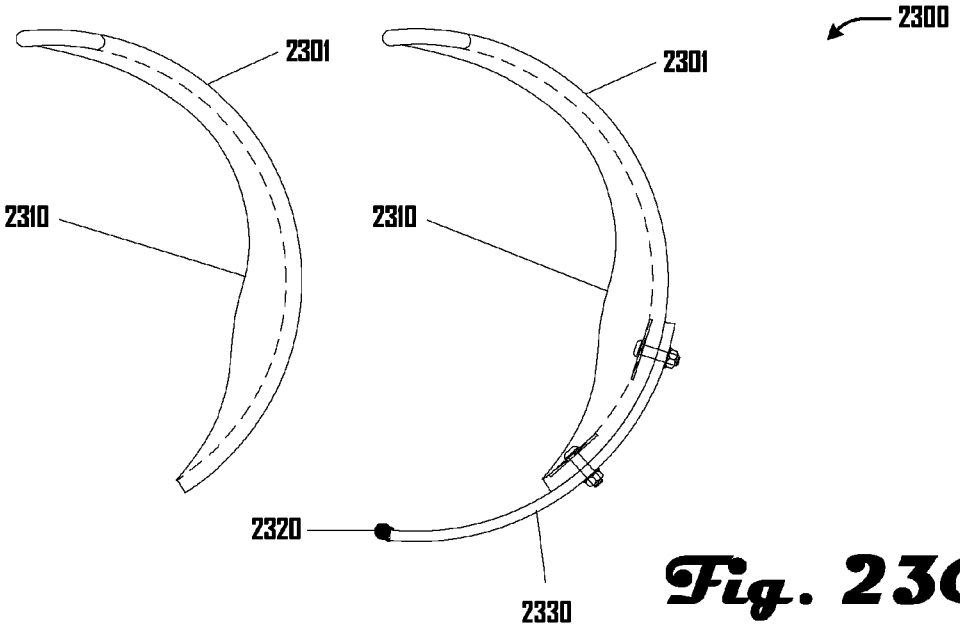
FIG. 23C illustrates a side elevation view of the Finger embodiment illustrated in FIG. 23A.

FIG. 23A illustrates a top plan view of a Finger 2300 embodiment. FIG. 23B illustrates a front elevation view of the Finger embodiment illustrated in FIG. 23A. FIG. 23C illustrates a side elevation view of the Finger embodiment illustrated in FIG. 23A. These Figures illustrate a Fingertip 2340 which is wider than the Finger Structure 2301, in addition to a pair of Tendons 2310, Finger Structure 2301 to which the Tendons 2310 are bonded or an integral part, Finger Mount 2230, and Finger Axle 2320.

Figure 24A:
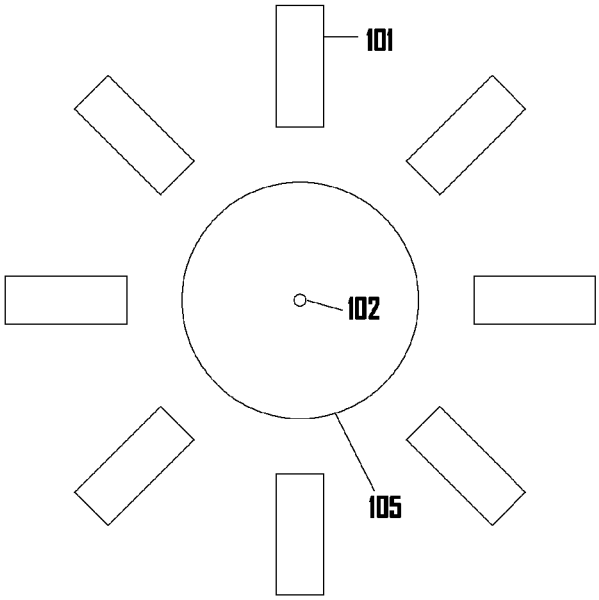
FIG. 24A illustrates a top plan schematic view of a Finger embodiment with Fingers extended.
Figure 24B:
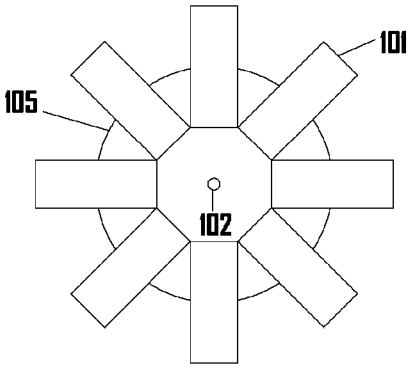
FIG. 24B illustrates a top plan schematic view of the Finger embodiment illustrated in FIG. 24A with Fingers retracted.

FIG. 24A illustrates a top plan schematic view of a Finger embodiment with Fingers 101 retracted from the Vertical Center Line 102. FIG. 24B illustrates a top plan schematic view of the Finger embodiment illustrated in FIG. 24A with Fingers 101 extended toward the Vertical Center Line 102 and abutting one another. The Fingers 101 in this embodiment are of a continuous width (the Fingertips are not narrower or wider).

Figure 25A:
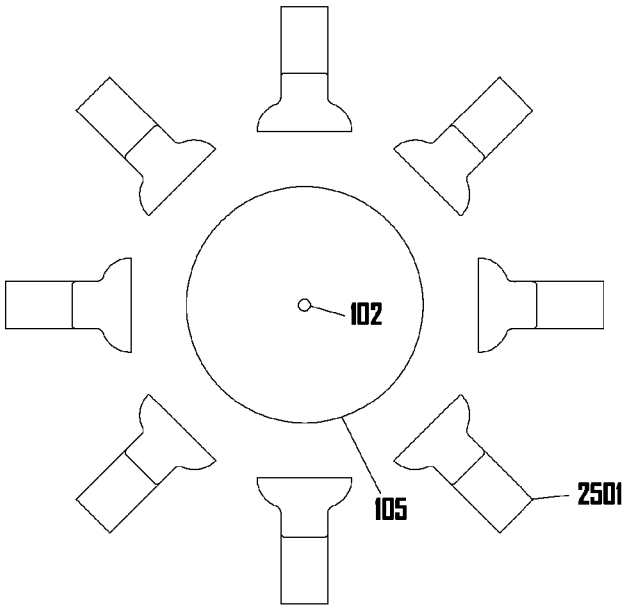
FIG. 25A illustrates a top plan schematic view of a Finger embodiment with Fingers extended.
Figure 25B:
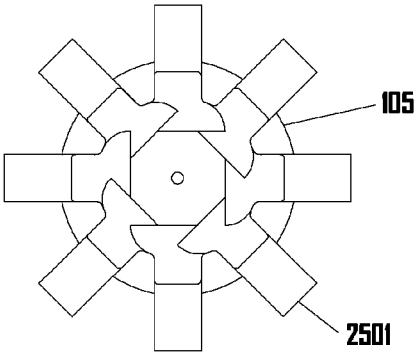
FIG. 25B illustrates a top plan schematic view of the Finger embodiment illustrated in FIG. 25A with Fingers retracted.

FIG. 25A illustrates a top plan schematic view of a Finger 2501 embodiment with Fingers refracted from the Vertical Center Line 102. FIG. 25B illustrates a top plan schematic view of the Finger embodiment illustrated in FIG. 25A with Fingers extended toward the Vertical Center Line 102 and overlapping, like shingles. This embodiment is discussed further below.

Figure 26A:
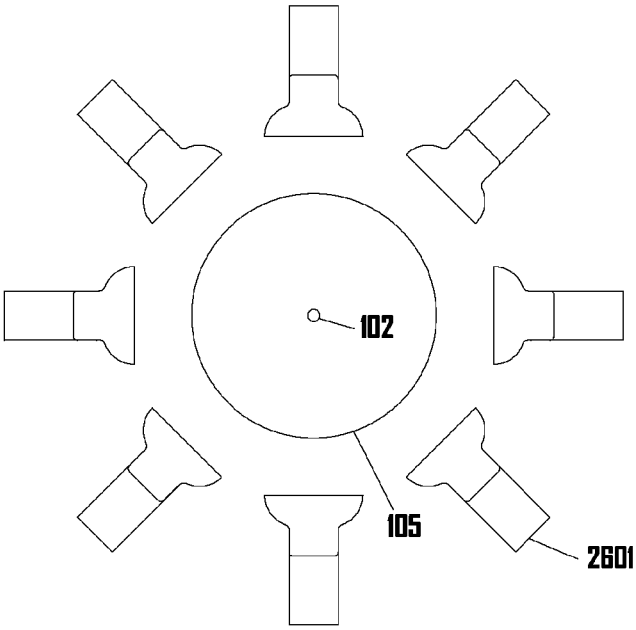
FIG. 26A illustrates a top plan schematic view of a Finger embodiment with Fingers extended.
Figure 26B:
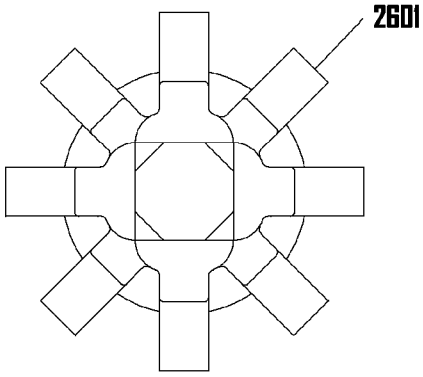
FIG. 26B illustrates a top plan schematic view of the Finger embodiment illustrated in FIG. 26A with Fingers retracted.

FIG. 26A illustrates a top plan schematic view of a Finger 2601 embodiment with Fingers refracted from the Vertical Center Line 102. FIG. 26B illustrates a top plan schematic view of the Finger embodiment illustrated in FIG. 26A with Fingers extended toward the Vertical Center Line 102 and overlapping on different levels. This embodiment is discussed further below.

FIG. 27A illustrates a top plan schematic view of a Finger 2701 embodiment with Fingers refracted from the Vertical Center Line 102. FIG. 27B illustrates a top plan schematic view of the Finger embodiment illustrated in FIG. 27A with Fingers extended toward the Vertical Center Line 102. This embodiment is discussed further below.

Figure 28A:
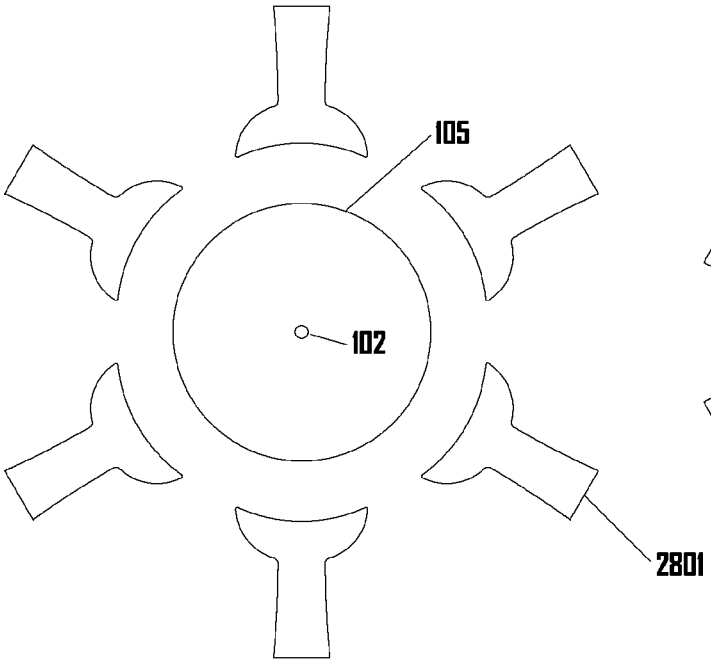
FIG. 28A illustrates a top plan schematic view of a Finger embodiment with Fingers extended.
Figure 28B:
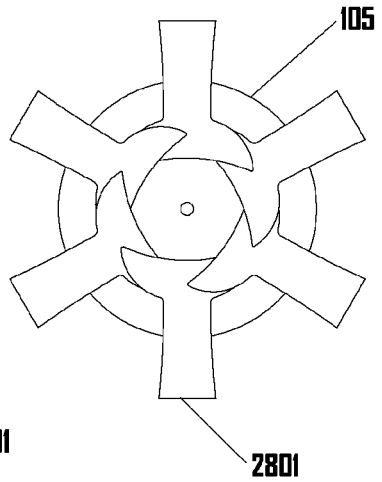
FIG. 28B illustrates a top plan schematic view of the Finger embodiment illustrated in FIG. 28A with Fingers retracted.

FIG. 28A illustrates a top plan schematic view of a Finger 2801 embodiment with Fingers refracted from the Vertical Center Line 102. FIG. 28B illustrates a top plan schematic view of the Finger embodiment illustrated in FIG. 28A with Fingers extended toward the Vertical Center Line 102 and overlapping, like shingles.

FIGS. 16A through 28 illustrate Finger embodiments. Generally speaking all of the illustrated Finger embodiments are approximately "C" shaped members with the top of the "C" being the "tip" of the Finger, or "Fingertip," which Fingertip is meant to come into contact with a log section and connect the log section to the Splitting Assistance Apparatus. The "C" shape of the Finger allows the Finger to deflect downward when the top or tip of the Finger is accidentally struck by an axe, reducing the amount of force which is transmitted to the Finger Control Ring 110 and preserving the useful life of the Finger and the Splitting Assistance Apparatus.

To reduce the outward deflection of the Finger, away from a log section when the Finger is extended to contact the log section, the Finger may be constructed from one continuous length of curved material with a modulus of flexibility selected to transmit enough compressive force inward, toward the log section when the Finger is extended, and with the modulus of flexibility selected to allow the Finger to still deflect downward when the top of the Finger is accidentally struck by an axe. An embodiment with a generally continuous single length of material is illustrated in FIGS. 16A, 16B, 17A and 17B. Example materials to fabricate these Finger embodiments include, for example, EPDM with a durometer value of between 85 to 95.

The Finger embodiments illustrated in FIGS. 18A through 20B and 22A through 23C comprise one or more interior straps or tendons, such as Tendon 1810, 1910, 2010, 2210, and 2310. These Tendons provide tension between the tip area of the Finger and the base of the Finger, near where it connects to the Chopping Deck 507 via the Finger Mount, thereby reducing deflection of the Finger outward, away from a log section when the Finger is extended to contact the log section. While reducing outward deflection, these Tendons also can readily deform when the Finger is accidentally struck from above, allowing the Finger to deflect downward. The Tendons may be a cord, wire, webbing, continuous structure, or similar.

The Finger embodiment illustrated in FIGS. 21A and 21B would generally be made from a material such as sheet spring steel or a stiff composite or polymer, and would be part of an array of a relatively large number of Fingers, as illustrated in FIGS. 27A and 27B. When accidentally struck from above, the axe would typically pass between the Fingers 2100 because they are narrow.

Wider Fingertips, such as Fingertips 2040, 2240, and 2340 may be utilized. The Fingertips, whether wider as in these examples or not, may be configured so as to abut together, as illustrated in FIGS. 24A and 24B, or to overlap, as illustrated in FIGS. 25B, 26B, and 28B. Abutting or overlapping Fingertips may be desirable to inhibit pieces of split log sections from falling out of the Splitting Assistance Apparatus when the Fingers are extended further toward smaller-diameter log sections. The leading edge of the overlapping Fingertips may have at an angle off of horizontal (when viewed in elevation from the front or back), as in FIGS. 24B and 27B, such that the Fingertips of adjacent Fingers overlap like shingles. Examples of this type of Finger embodiment are illustrated in FIGS. 9, 10, and 11. The Fingertips may be arranged at slightly different elevations above the Chopping Surface 105, as in FIG. 26B, such that the Fingertips of adjacent Fingers overlap, one Fingertip entirely above the other. FIGS. 24A and 24B illustrate abutting Fingertips. The Fingertips may be provided with a structure or surface to increase friction with or "bite into" a log section, such as Finger Nail 1740 in FIGS. 17A and 17B.

As an example, HDPE may be utilized to fabricate a Finger and UHMW may be utilized to fabricate a tendon.

The invention claimed is:

1. A log section splitting assistance apparatus comprising:
a base;
fingers attached to the base;
wherein the fingers are configured to connect a log section to the base;
wherein each finger attaches to the base at an axle with a horizontally oriented axis of rotation and further comprising a mechanism to rotate the fingers up and down about the axles of the fingers,
wherein the mechanism comprises a ring which may be changed in elevation relative to a column within the base, wherein the ring contacts the bottom of the fingers and rotates the fingers about the axles when the ring changes in elevation.

2. The log section splitting assistance apparatus of claim 1, further comprising a lever arm attached to the ring via a connecting rod and attached to the base at a lever-arm axle, wherein rotation of the lever arm about the lever-arm axle changes the elevation of the ring.

3. The log section splitting assistance apparatus of claim 2, further comprising a locking mechanism to lock the rotational position of the lever-arm about the lever-arm axle.

4. The log section splitting assistance apparatus of claim 3, wherein the locking mechanism comprises:
an arc section attached to the base and centered about the lever-arm axle; and a secondary lever-arm attached to the lever arm at a secondary lever-arm axle, wherein the secondary lever-arm comprises two rods which may bind to the arc section through compression and friction when the secondary lever-arm rotates about the secondary lever-arm axle.

5. The log section splitting assistance apparatus of claim 4, wherein the locking mechanism further comprises a return spring, wherein the return spring applies downward pressure on the ring, and a locking mechanism engage spring, wherein the locking mechanism engage spring biases the secondary lever-arm to rotate about the secondary lever-arm axle and to bind the two rods to the arc section.

6. The log section splitting assistance apparatus of claim 1, wherein the fingers attach to a plate, wherein the plate is connected to the base via an axle with vertically oriented axis of rotation about which the fingers may rotate in a horizontal plane.

7. The log section splitting assistance apparatus of claim 6, further comprising a projection attached to the plate, wherein the projection is configured to allow a user to rotate the fingers about the vertically oriented axis of rotation.

8. The log section splitting assistance apparatus of claim 7, wherein the projection comprises a bar radial to the plate and a rod protruding up from the bar.

9. The log section splitting assistance apparatus of claim 7, further comprising a number of projections, wherein the number is a fraction of the number of fingers.

10. The log section splitting assistance apparatus of claim 1, comprising an integer number of fingers between and including three and eight.

11. The log section splitting assistance apparatus of claim 1, wherein the fingers comprise a mount to attach the fingers to the base.

12. The log section splitting assistance apparatus of claim 1, wherein the fingers comprise an arc.

13. A log section splitting assistance apparatus comprising:
a base;
fingers attached to the base;
wherein the fingers are configured to connect a log section to the base;
wherein each finger attaches to the base at an axle with a horizontally oriented axis of rotation and further comprising a mechanism to rotate the fingers up and down about the axles of the fingers,
wherein each finger comprises an arc and a tendon spanning a chord of the arc, wherein the tendon allows the fingers to compress, when impacted from above, and wherein the tendon resists expansion of the arc.

14. A log section splitting assistance apparatus comprising:
a base;
fingers attached to the base;
wherein the fingers are configured to connect a log section to the base;
wherein each finger attaches to the base at an axle with a horizontally oriented axis of rotation and further comprising a mechanism to rotate the fingers up and down about the axles of the fingers,
wherein each finger comprises an arc and wherein the fingers comprise fingertips distal to the horizontally oriented axles, wherein the fingertips may become proximate when the fingers rotate up about the horizontally oriented axles.

15. The log section splitting assistance apparatus of claim 14, wherein the fingertips are wider than the fingers.

16. The log section splitting assistance apparatus of claim 14, wherein the fingertips may abut when they become proximate.

17. The log section splitting assistance apparatus of claim 14, wherein the fingertips may overlap when they become proximate.

* * * * *